US011718462B2

(12) United States Patent
Ho et al.

(10) Patent No.: US 11,718,462 B2
(45) Date of Patent: Aug. 8, 2023

(54) LOADING BOX

(71) Applicant: AU OPTRONICS CORPORATION, Hsin-Chu (TW)

(72) Inventors: Chih-Chueh Ho, Hsin-Chu (TW); Shih-Chi Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/703,343

(22) Filed: Mar. 24, 2022

(65) Prior Publication Data

US 2022/0324632 A1 Oct. 13, 2022

(30) Foreign Application Priority Data

Apr. 9, 2021 (TW) ..... 110112993
Nov. 9, 2021 (TW) ..... 110141699

(51) Int. Cl.
*B65D 81/05* (2006.01)

(52) U.S. Cl.
CPC ..... *B65D 81/053* (2013.01)

(58) Field of Classification Search
CPC .... B65D 81/022; B65D 81/107; B65D 81/07; B65D 81/05; B65D 81/054; B65D 81/053; B65D 2581/051
USPC ..... 206/449, 586, 587, 591, 454, 455
See application file for complete search history.

(56) References Cited

U.S. PATENT DOCUMENTS 5,518,118 A * 5/1996 Putz ..... B65D 85/30 206/451
7,644,820 B2 * 1/2010 Hohne ..... B65D 81/1275 206/523
8,789,698 B2 * 7/2014 Kuo ..... B65D 81/022 349/58
9,010,534 B2 * 4/2015 Kuo ..... H01L 21/67363 206/521
10,065,783 B2 * 9/2018 Zhao ..... B65D 81/07
10,457,464 B2 * 10/2019 Lv ..... B65D 81/107
11,008,150 B2 * 5/2021 Nakamichi ..... B65D 81/053
11,247,830 B2 * 2/2022 Uchida ..... B65D 81/05
(Continued)

FOREIGN PATENT DOCUMENTS

CN 102673905 A 9/2012
CN 202953316 U 5/2013
(Continued)

*Primary Examiner* — Chun Hoi Cheung
(74) *Attorney, Agent, or Firm* — WPAT, P.C

(57) ABSTRACT

The present invention provides a loading box, which includes a box body, a first groove set, and a first positioning member. The box body includes a base and a side wall protruding from the base along a plurality of sides of the base. The first groove set has a plurality of first grooves, and is disposed on the base along a first side. The first positioning member is arranged corresponding to the first groove set, and includes: a first baffle, detachably inserted into one of the first grooves in the first groove set; and a first supporting arm and a second supporting arm, respectively connected to the first baffle and protruding from the first baffle toward the side wall. One ends of the first supporting arm and the second supporting arm of the first positioning member away from the first baffle are detachably connected to the box body.

21 Claims, 16 Drawing Sheets

(56) References Cited

U.S. PATENT DOCUMENTS

| | | | | |
|---|---|---|---|---|
| 2008/0128310 | A1* | 6/2008 | Kao | B65D 81/107 206/521 |
| 2013/0270134 | A1* | 10/2013 | Chen | B65D 81/02 53/472 |
| 2013/0306514 | A1* | 11/2013 | Hu | B65D 81/053 206/586 |
| 2014/0069834 | A1* | 3/2014 | Kuo | B65D 81/052 206/454 |
| 2014/0097121 | A1* | 4/2014 | Chen | B65D 81/053 206/586 |
| 2017/0291736 | A1* | 10/2017 | Hao | B65D 81/05 |
| 2018/0086503 | A1* | 3/2018 | Wang | B65B 5/04 |
| 2020/0071052 | A1* | 3/2020 | Cheng | B65D 85/68 |
| 2020/0122913 | A1* | 4/2020 | Sim | B65D 85/30 |

FOREIGN PATENT DOCUMENTS

| | | | |
|---|---|---|---|
| CN | 205738601 | U | 11/2016 |
| TW | M314190 | U | 6/2007 |

* cited by examiner

LOADING BOX

TECHNICAL FIELD

The present invention relates to a loading box, and in particular to a loading box including a positioning member having a baffle and a supporting arm.

BACKGROUND

During the receiving, storing, or transporting of objects, in order to reduce or avoid damage, it is often necessary to place the objects in a loading box. However, in practice, it is difficult to develop specific loading boxes for various objects, and it may be difficult for a loading box having a preset size to be widely applicable to objects of various sizes. In addition, it is time-consuming to open molds for producing new loading boxes to load specific objects, and the cost would be increased correspondingly. Further, if the accommodating space of the loading box is adjusted and modified by pasting a cushion or cutting the structure of the loading box, the complexity and the duration of the operation may be increased unexpectedly, and it is difficult to reuse the adjusted and modified loading box. Therefore, in order to improve the versatility and reusability of the loading box, it is required to develop a loading box having the corresponding accommodating space that can be adjusted according to sizes of to-be-loaded objects.

SUMMARY

Technical Means for Resolving the Problem

In order to solve the above problems, an embodiment of the present invention provides a loading box, including: a box body, including a base and a side wall protruding from the base along a plurality of sides of the base; a first groove set, having a plurality of first grooves and disposed on the base along a first side of the sides; and a first positioning member, disposed corresponding to the first groove set. The first positioning member includes: a first baffle, detachably inserted into one of the first grooves in the first groove set; and a first supporting arm and a second supporting arm, respectively connected to the first baffle and protruding from the first baffle toward the side wall. One ends of the first supporting arm and the second supporting arm of the first positioning member away from the first baffle are detachably connected to the box body.

Another embodiment of the present invention provides a loading box, including: a box body, including a base and a side wall protruding from the base along a plurality of sides of the base, where the sides include a first side and a second side intersecting with each other, and the side wall includes a first side wall portion located on the first side and a second side wall portion located on the second side; and a first positioning member. The first positioning member includes: a first baffle, disposed along the first side; and a first supporting arm and a second supporting arm, respectively connected to the first baffle and protruding from the first baffle toward the side wall. One ends of the first supporting arm and the second supporting arm of the first positioning member away from the first baffle are detachably connected to the box body respectively corresponding to the first side wall portion and the second side wall portion. The second supporting arm of the first positioning member is an arcuate supporting arm having a radian, and a center of curvature of the second supporting arm having the radian is located on a side of the second supporting arm opposite to the side wall.

Benefits Compared to the Prior Art

According to the loading box provided in the embodiments of the present invention, an accommodating space of an existing loading box can be adjusted based on at least one positioning member without modifying the loading box by means of cutting or pasting, so that the versatility of the same loading box applicable to to-be-loaded objects can be improved. In addition, according to the loading box provided in the embodiments of the present invention, the box body and the positioning member can be both reused repeatedly. In this way, the resources and costs required for receiving, storing, or transporting the objects can be reduced, and circular economy and an environment-friendly industry can be promoted by relatively reducing the generation of waste.

DETAILED DESCRIPTION

Embodiments are described in the following, and a person of ordinary skill in the art should easily understand the spirit and the principle of the present invention with reference to the accompanying drawings. However, even though some specific embodiments may be described in detail in this specification, the embodiments are merely examples, and shall not be regarded as limitations or exhaustive meanings in terms of every aspect. Therefore, for a person of ordinary skill in the art, variations and amendments of the present invention may be obvious and may be achieved easily without departing from the spirit and the principle of the present invention.

Figure 1A:
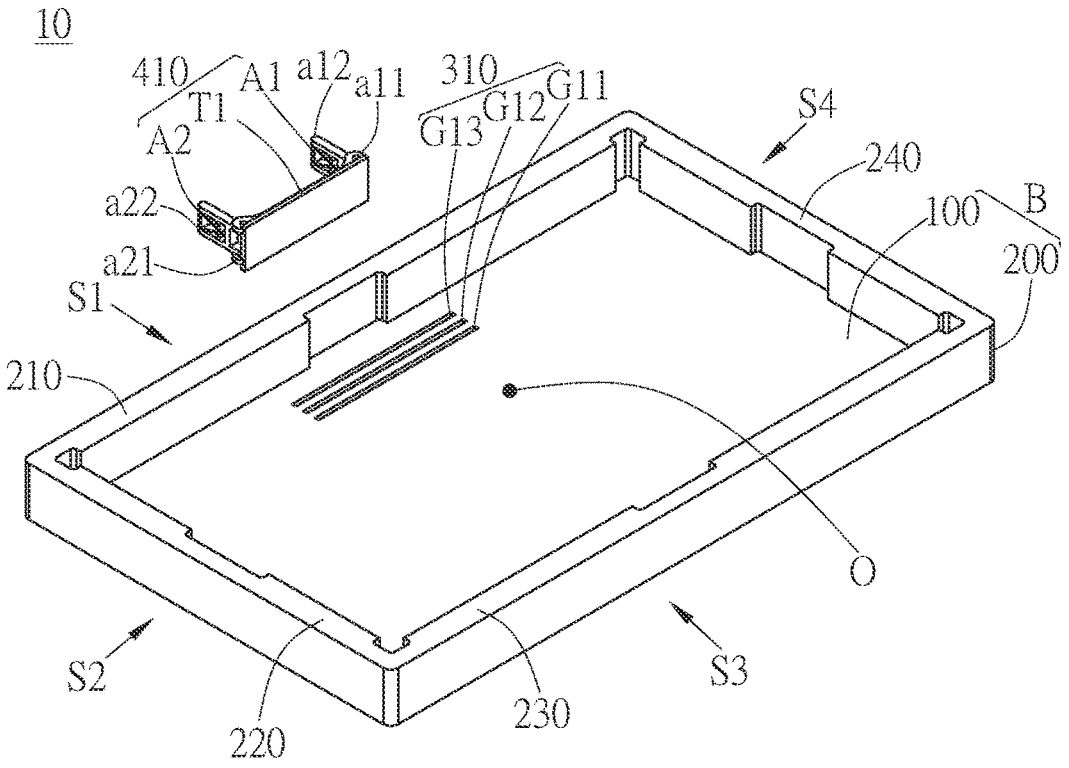
FIG. 1A is a three-dimensional schematic diagram of a loading box in which a positioning member can be assembled according to an embodiment of the present invention.
Figure 1B:
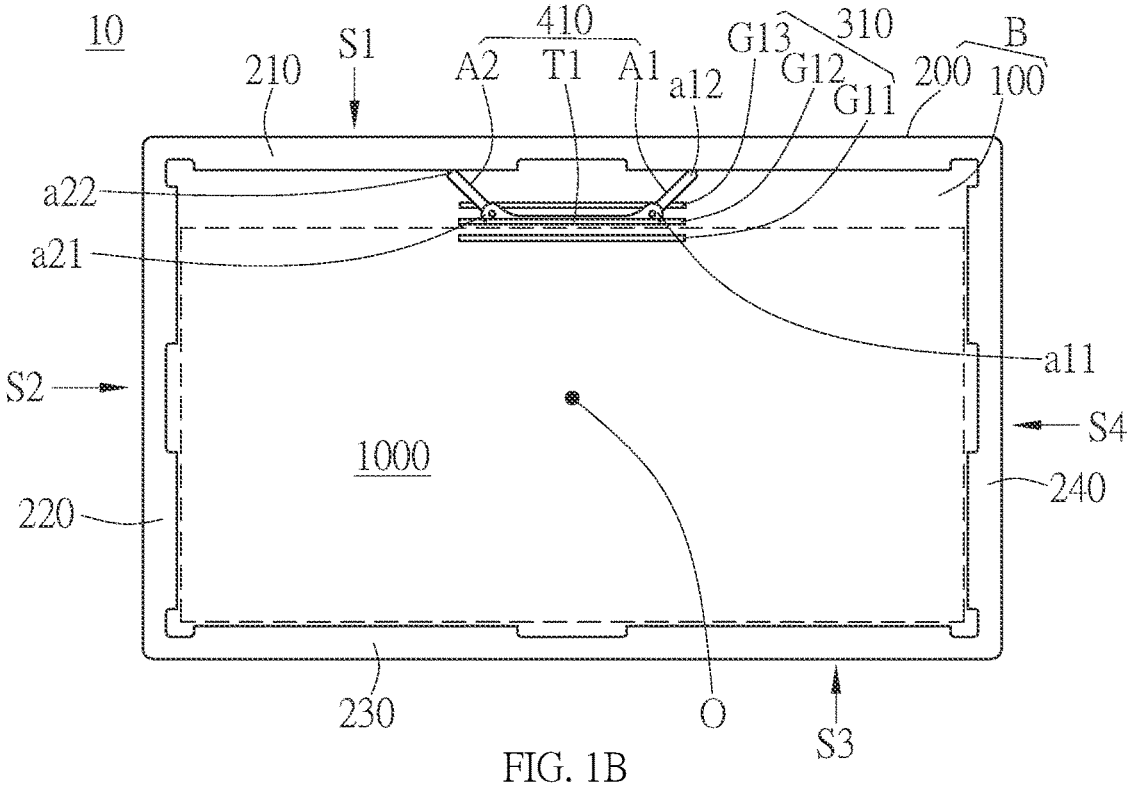
FIG. 1B is a schematic top view of the loading box assembled with a positioning member according to an embodiment of the present invention.

Referring to FIG. 1A and FIG. 1B, an embodiment of the present invention provides a loading box 10. The loading box 10 includes a box body B, a first groove set 310, and a first positioning member 410. Specifically, the box body B includes a base 100 configured to bear a to-be-loaded object 1000, and a side wall 200 protruding from the base 100 along a plurality of sides of the base 100. For example, the base 100 may have a first side S1, a second side S2, a third side S3, and a fourth side S4. The side wall 200 may have a first side wall portion 210, a second side wall portion 220, a third side wall portion 230, and a fourth side wall portion 240 that respectively extend along the first side S1, the second side S2, the third side S3, and the fourth side S4. However, the above are merely examples, and the present invention is not limited thereto. For example, according to other embodiments, the box body B may also have a shape other than a quadrangle and have another number of sides other than four sides. In addition, the first side wall portion 210, the second side wall portion 220, the third side wall portion 230, and the fourth side wall portion 240 shown in FIG. 1A and FIG. 1B are substantially connected to each other and integrally formed. However, according to other embodiments, the first side wall portion 210, the second side wall portion 220, the third side wall portion 230, and the fourth side wall portion 240 may also be separated from each other. Alternatively, the first side wall portion 210, the second side wall portion 220, the third side wall portion 230, and the fourth side wall portion 240 may also each have a plurality of separate sections. As described above, an implementation of the side wall 200 in the embodiments of the present invention is not limited to the implementation described in detail or illustrated herein.

According to this embodiment, the first groove set 310 may be disposed in the loading box 10. Specifically, the first groove set 310 may have a plurality of first grooves, for example, three first grooves G11, G12, and G13, but the present invention is not limited thereto. For example, one, two, four or even more first grooves may also be provided. As described above, the plurality of first grooves G11, G12, and G13 may be provided on the base 100 along the first side S1. For example, the first grooves G11, G12, and G13 may be formed on the base 100 recessed to a depth of 10 mm, but this is merely an example, and the shape and the depth of the groove of the present invention are not limited thereto.

The loading box 10 may further have the first positioning member 410 disposed corresponding to the first groove set 310. The first positioning member 410 may include a first baffle T1, and a first supporting arm A1 and a second supporting arm A2 respectively connected to the first baffle T1 and protruding from the first baffle T1. As shown in FIG. 1A, the first baffle T1 is detachably inserted into one of the first groove G11, the first groove G12, or the first groove G13 in the first groove set 310. After the first baffle T1 is inserted into one of the first groove G11, the first groove G12, or the first groove G13, as shown in FIG. 1B, the first supporting arm A1 and the second supporting arm A2 may be respectively connected to the first baffle T1, and may protrude from the first baffle T1 toward the side wall 200. For example, the first supporting arm A1 and the second supporting arm A2 may be respectively connected to a side of the first baffle T1 facing the side wall 200, and may protrude away from a center O of the base 100 of the box body B toward the first side wall portion 210. However, the above are merely examples. According to other embodiments of the present invention, the implementation of the first supporting arm A1 and the second supporting arm A2 connected to the first baffle T1 and protruding toward the side wall 200 is not limited thereto.

Specifically, ends a12 and a22 of the first supporting arm A1 and the second supporting arm A2 of the first positioning member 410 away from the first baffle T1 are detachably connected to the box body B respectively. For example, as shown in FIG. 1B, the first supporting arm A1 of the first positioning member 410 may have an end a11 connected to the first baffle T1 and the end a12 connected to the box body B. The second supporting arm A2 of the first positioning member 410 may have an end a21 connected to the first baffle T1 and the end a22 connected to the box body B. For example, lengths of the first supporting arm A1 and the second supporting arm A2 may be respectively equal to or greater than a distance between the first baffle T1 and the closest side wall 200. Therefore, the end a12 of the first supporting arm A1 and the end a22 of the second supporting arm A2 may abut against the side wall 200 or are connected to the side wall 200 in other manners. However, according to other embodiments, the end a12 of the first supporting arm A1 and the end a22 of the second supporting arm A2 may also be connected to the base 100 corresponding to the side wall 200 and spaced apart from the side wall 200. For example, the ends a12 and a22 may be connected to the base 100 only by using holes on the base 100, so as to be detachably connected to the box body B without directly abutting against the side wall 200. Alternatively, a combination of these forms or means without conflicting each other may be used to improve the stability of the detachable connection to the box body B. As described above, the form and the manner in which the ends a12 and a22 of the first supporting arm A1 and the second supporting arm A2 of the first positioning member 410 are detachably connected to the box body B are not limited to the implementation specifically described herein.

Figure 2:
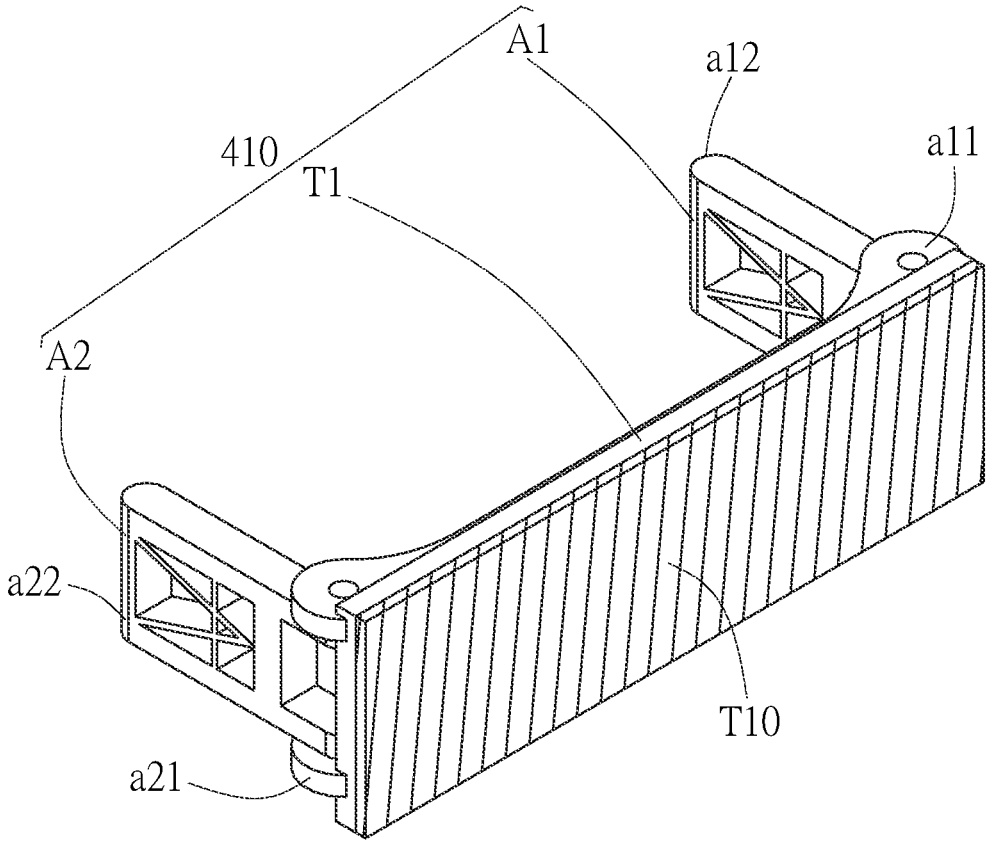
FIG. 2 is a schematic diagram showing a buffer plate further disposed on a positioning member according to an embodiment of the present invention.

According to some embodiments of the present invention, the first baffle T1 may be made of a material such as plastic and metal that has enough rigidity to maintain upright insertion into one of the first groove G11, the first groove G12, or the first groove G13 without deformation. In this case, according to still another embodiment, referring to FIG. 1B and FIG. 2, the loading box 10 may further include a buffer plate T10 attached to a side of the first baffle T1 facing the center O of the base 100. The buffer plate T10 may be made of a material more flexible than that of the first baffle T1. Specifically, the buffer plate T10 made of a material more flexible than that of the first baffle T1 means that a Young's modulus of the material of the buffer plate T10 is lower than a Young's modulus of the material of the first baffle T1. Therefore, the buffer plate T10 may have a rigidity less than the first baffle T1. Therefore, the buffer plate T10 may be used as a buffer between the first baffle T1 and the loaded object 1000, so as to prevent the first baffle T1 with greater rigidity from directly abutting against the loaded object 1000.

Figure 3A:
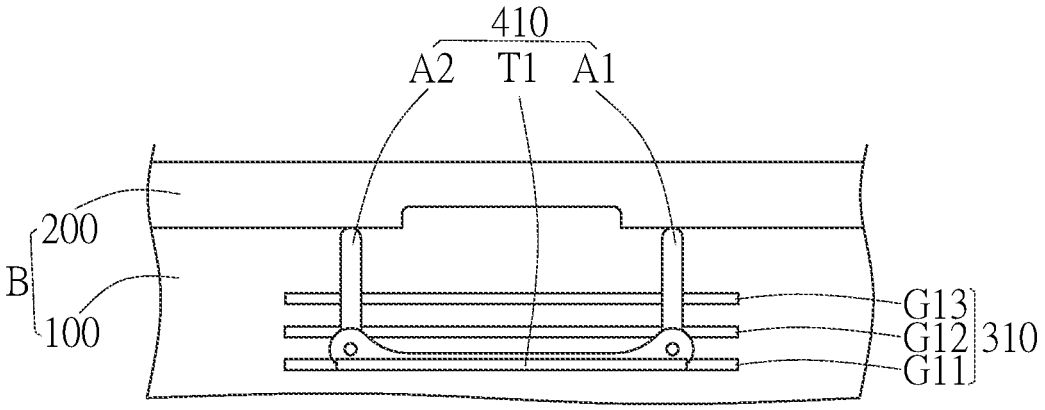
FIG. 3A to FIG. 3C are each a schematic top view showing adjustment of an arrangement position of a positioning member corresponding to a size of a to-be-loaded object according to an embodiment of the present invention.
Figure 3B:
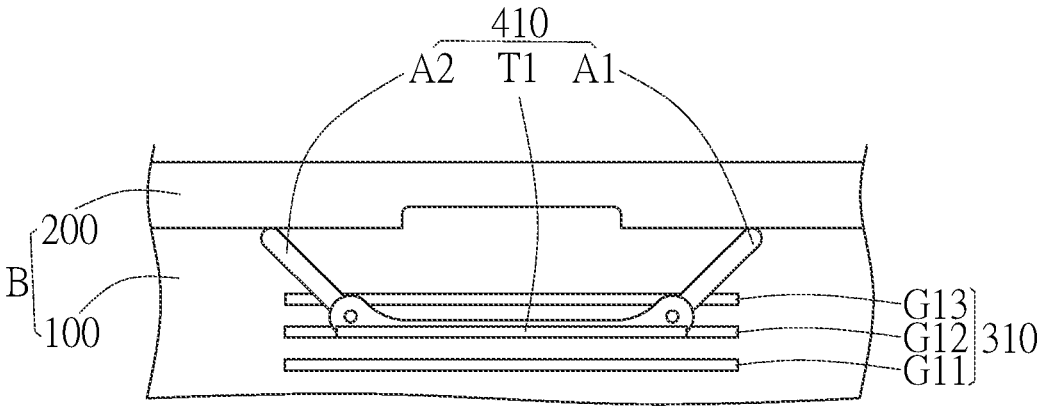
Figure 3C:
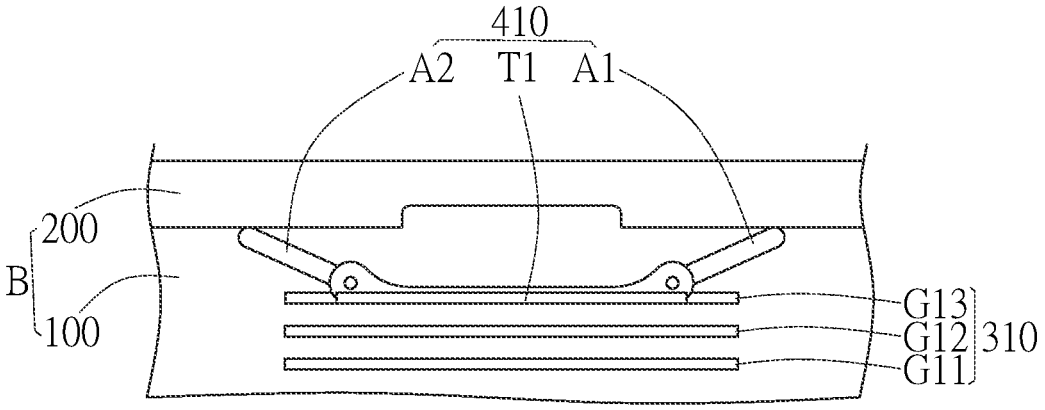
Figure 4A:
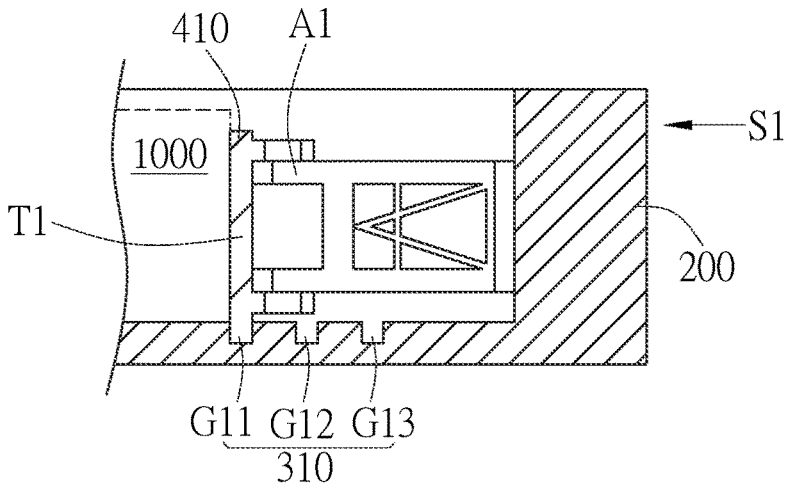
FIG. 4A to FIG. 4C are each a schematic cross-sectional view showing adjustment of an arrangement position of a positioning member corresponding to a size of a to-be-loaded object according to an embodiment of the present invention.
Figure 4B:
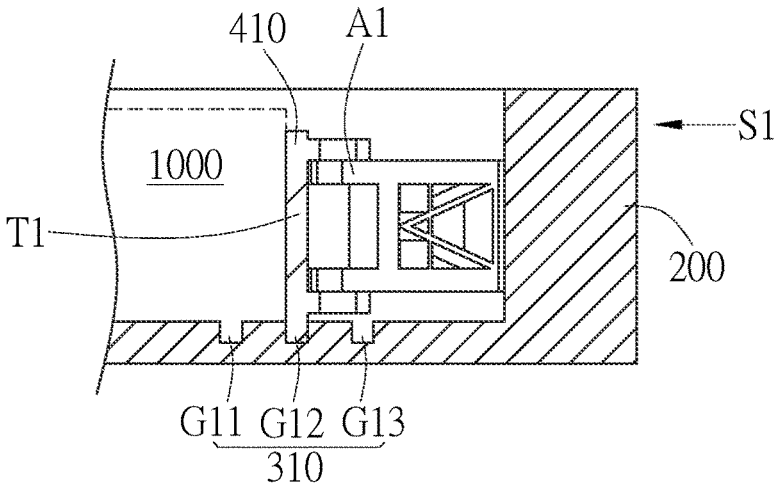
Figure 4C:
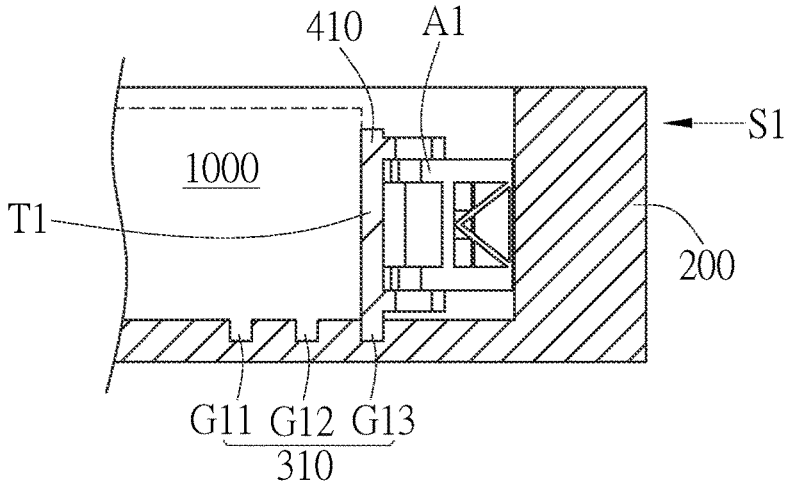

Next, referring to FIG. 3A to FIG. 3C and FIG. 4A to FIG. 4C together with FIG. 1B, according to the loading box 10 of this embodiment, an accommodating space may be adjusted based on a predicted size of the to-be-loaded object 1000. Specifically, as shown in FIG. 1B, a size of the accommodating space of the to-be-loaded object 1000 may be determined based on one of the first groove G11, the first groove G12, or the first groove G13 into which the first baffle T1 of the first positioning member 410 is inserted. As described above, FIG. 3A and FIG. 4A cooperatively show an implementation in which the first baffle T1 is inserted into the first groove G11 nearest the center O of the base 100. FIG. 3B and FIG. 4B cooperatively show an implementation in which the first baffle T1 is inserted into the first groove G12. FIG. 3C and FIG. 4C cooperatively show an implementation in which the first baffle T1 is inserted into the first groove G13 farthest away from the center O of the base 100.

In this embodiment, the first positioning member 410 corresponding to the implementation of FIG. 3A and FIG. 4A, the implementation of FIG. 3B and FIG. 4B, and the implementation of FIG. 3C and FIG. 4C may be different assemblies. During the implementation, the corresponding assembly for the first positioning member 410 may be selected based on the size of the to-be-loaded object 1000. Alternatively, according to some embodiments of the present invention, the first supporting arm A1 and/or the second supporting arm A2 of the first positioning member 410 are/is rotatable relative to the first baffle T1. For example, one ends of the first supporting arm A1 and the second supporting arm A2 connected to the first baffle T1 may have cylindrical rotary shafts, and may be correspondingly inserted into a round hole bearing of the first baffle T1, thereby realizing the rotatability. However, the implementation of the present invention is not limited thereto. Therefore, for the same first positioning member 410, angles of the first supporting arm A1 and the second supporting arm A2 relative to the first baffle T1 may be adjusted based on one of the first groove G11, the first groove G12, or the first groove G13 into which the first baffle T1 is inserted. In this way, the angles and positions of the first supporting arm A1 and the second supporting arm A2 may be adjusted to be detachably connected to the box body B such as the first side wall portion 210, so as to achieve an objective of positioning and defining different accommodating spaces.

According to some embodiments, the angles/angle of the first supporting arm A1 and/or the second supporting arm A2 relative to the first baffle T1 may be adjusted between 90 degrees and 180 degrees. For example, the angle may be 90 degrees, 120 degrees, 130 degrees, 135 degrees, 165 degrees, or the like. However, the above are merely examples, and the present invention is not limited thereto.

As described above, as shown in FIG. 4A to FIG. 4C, when the first baffle T1 of the first positioning member 410 is inserted more closer to the side wall 200 (for example, the first side wall portion 210) of the corresponding side (for example, the first side S1), a larger to-be-loaded object 1000 may be loaded. Therefore, the loading boxes 10 having a same size may be used for loading the objects 1000 having different sizes, thereby improving the versatility of the loading box 10. In addition, the operation of inserting into the first groove set 310 and adjusting the first supporting arm A1 and the second supporting arm A2 does not involve cutting and pasting, so that a loading process can be simplified, and damage to the loading box 10 can be reduced or avoided. In addition, the inaccuracy of pasting or cutting and the possibility of deformation and falling off from a corresponding modified structure are also reduced or avoided. Therefore, after use, the loading box may also be reused for other objects having the same size or different sizes, thereby improving the reusability of the loading box 10.

Further, according to some embodiments, the loading box 10 may be designed to be a size applicable to a production line or an automation. Specifically, due to the above simplified assembling or loading process, the loading box 10 of this embodiment may also be applied to the production line or the automated process under the limitation of the size of the operating machine. Therefore, the defect that a larger box body having a more modification space for the complex cutting and pasting is not applicable to the size of the operating machine and may not be suitable for automation, further causing the time-consuming operation, can be avoided.

In addition, according to this embodiment, since the first baffle T1 is inserted into the first groove set 310, a gap between a bottom edge of the first baffle T1 and the base 100 is not to overlap with the to-be-loaded object 1000, the to-be-loaded object 1000 in the sheet stack can further be reduced or prevented from slipping out of the gap to cause unintended inserting or breaking.

Figure 5A:
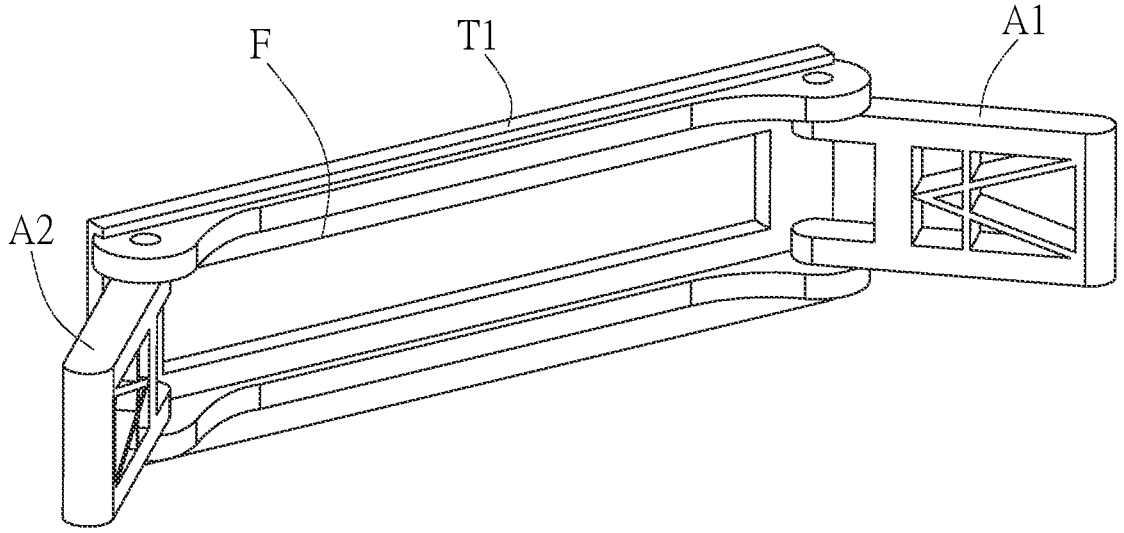
FIG. 5A and FIG. 5B are each a schematic diagram of a baffle of a positioning member that is partially hollowed-out.
Figure 5B:
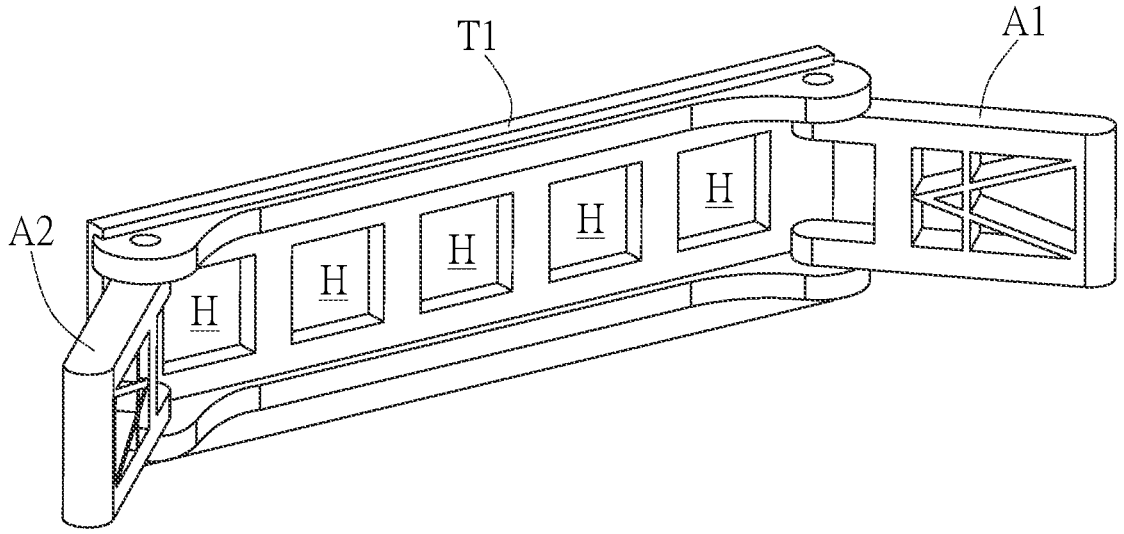

In some embodiments, in order to further reduce the materials, as shown in FIG. 5A and FIG. 5B, the first baffle T1 may also be at least partially hollowed-out, for example, formed into a hollow frame F or having hollowed-out areas H with an expected shape, size, and number. However, FIG. 5A and FIG. 5B are merely examples, and the implementations of the first baffle T1 in the embodiments of the present invention are not limited thereto.

Figure 6:
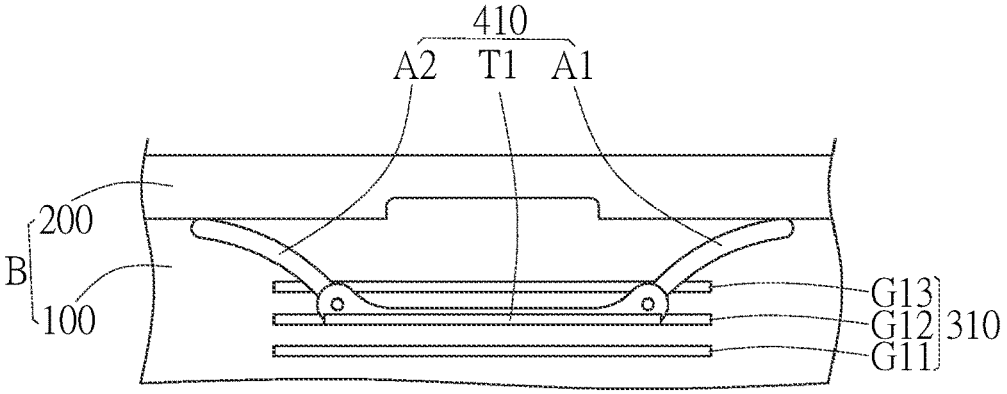
FIG. 6 is a schematic diagram of a positioning member including an arcuate supporting arm having a radian according to an embodiment of the present invention.

Further, referring to FIG. 6, according to some embodiments of the present invention, at least one of the first supporting arm A1 or the second supporting arm A2 of the first positioning member 410 may be an arcuate supporting arm having a radian. Therefore, with the assistance of the first positioning member 410 for positioning, when the loading box 10 is impacted, stress on the loaded object 1000 may further be counteracted or buffered by means of the elasticity of the arcuate supporting arm, and/or transmitted to the box body B, so as to further reduce or avoid the damage to the loaded object 1000.

Figure 7A:
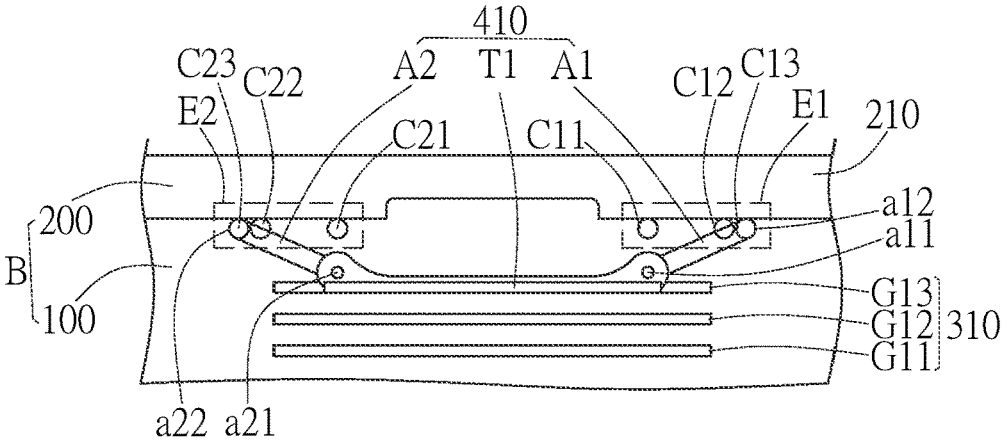
FIG. 7A is an enlarged schematic diagram of a positioning member corresponding to connecting portions according to an embodiment of the present invention.
Figure 7B:
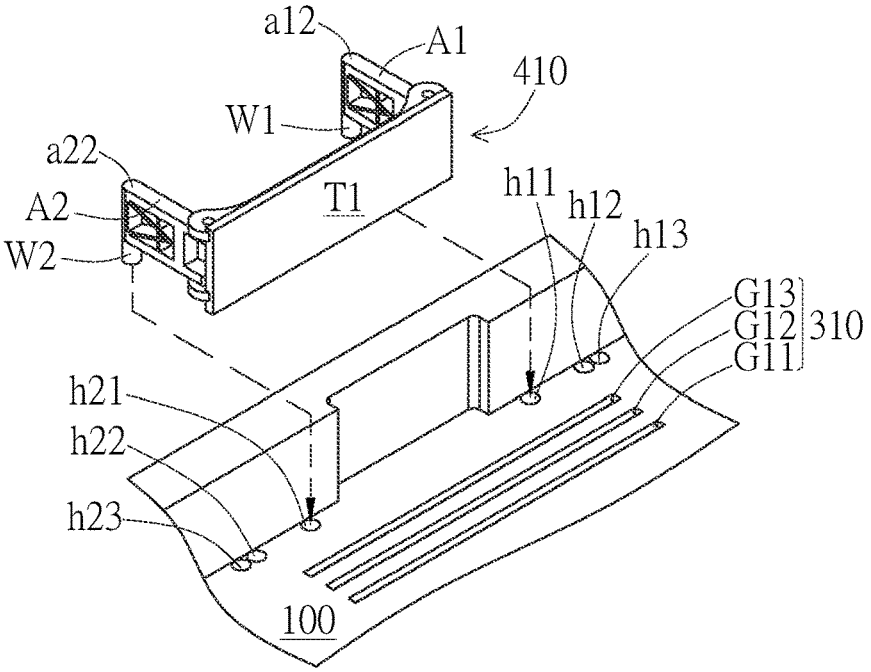
FIG. 7B is a schematic diagram of an exemplary implementation of contacts of a connecting portion being holes according to an embodiment of the present invention.

Then, according to some embodiments, referring to FIG. 7A and FIG. 7B together with FIG. 1B, the manner in which the first supporting arm A1 and the second supporting arm A2 of the first positioning member 410 are detachably connected to the box body B is further described.

As described above, according to this embodiment, specifically, the end a12 of the first supporting arm A1 and the end a22 of the second supporting arm A2 may be detachably connected to the box body B respectively at a first connecting portion E1 and a second connecting portion E2 disposed along the side wall 200. For example, the end a12 of the first supporting arm A1 and the end a22 of the second supporting arm A2 away from the first baffle T1 are detachably connected to, for example, abut against the first side wall portion 210. In addition, the first connecting portion E1 may have a plurality of first contacts C11, C12, and C13 disposed along the first side wall portion 210. The second connecting portion E2 may have a plurality of second contacts C21, C22, and C23 disposed along the first side wall portion 210. Thus, the end a12 of the first supporting arm A1 of the first positioning member 410 away from the first baffle T1 may be selectively connected to one of the first contact C11, the first contact C12, or the first contact C13 and abuts against the first side wall portion 210. The end a22 of the second supporting arm A2 of the first positioning member 410 away from the first baffle T1 may be selectively connected to one of the second contact C21, the second contact C22, or the second contact C23 and abuts against the first side wall portion 210. Therefore, the stability and accuracy of the end a12 of the first supporting arm A1 and the end a22 of the second supporting arm A2 being detachably connected to the box body B such as the first side wall portion 210 may further be enhanced. However, according to other embodiments, in a case that the end a12 of the first supporting arm A1 and the end a22 of the second supporting arm A2 do not abut against the first side wall portion 210, the end a12 of the first supporting arm A1 and the end a22 of the second supporting arm A2 are directly connected to one of the first contact C11, the first contact C12, or the first contact C13 or one of the second contact C21, the second contact C22, or the second contact C23 to detachably connect the end a12 of the first supporting arm A1 and the end a22 of the second supporting arm A2 to the box body B. Alternatively, in a case that the end a12 of the first supporting arm A1 and the end a22 of the second supporting arm A2 are not connected to one of the first contact C11, the first contact C12, or the first contact C13 or one of the second contact C21, the second contact C22, or the second contact C23, the end a12 of the first supporting arm A1 and the end a22 of the second supporting arm A2 abut against the first side wall portion 210 to detachably connect the end a12 of the first supporting arm A1 and the end a22 of the second supporting arm A2 to the box body B.

According to this embodiment, number of the first contacts C11, C12, and C13 is the same as number of the first grooves G11, G12, and G13 in the first groove set 310. That is, the first grooves G11, G12, and G13 into which the first positioning member 410 is inserted respectively correspond to the first contacts C11, C12, and C13. For example, when the first baffle T1 of the first positioning member 410 is inserted into the first groove G11, the end a12 of the first supporting arm A1 may be selectively connected to the first contact C11. In addition, a similar arrangement may also be correspondingly performed for the second supporting arm A2 and the second contacts C21, C22, and C23, so that the end a22 of the second supporting arm A2 may be selectively connected to the second contacts C21, C22, and C23, and the details are not described again.

According to some embodiments, as shown in FIG. 7B, the first contacts C11, C12, and C13 and the second contacts C21, C22, and C23 may respectively be a plurality of first holes h11, h12, and h13 and a plurality of second holes h21, h22, and h23. As described above, the first holes h11, h12, and h13 and the second holes h21, h22, and h23 are respectively formed on the base 100 (as shown in FIG. 7B). However, this is merely an example, and the first holes h11, h12, and h13 and the second holes h21, h22, and h23 may also be respectively formed on the side wall 200 (not shown in FIG. 7B). For example, the side wall 200 may partially have a lower recessed area (not shown in FIG. 7B). The first holes h11, h12, and h13 and the second holes h21, h22, and h23 are formed in the relatively lower recessed area and may be used for the end a12 of the first supporting arm A1 and the end a22 of the second supporting arm A2 to be inserted. In this way, the first supporting arm A1 and the second supporting arm A2 can be connected to the side wall 200 more stably. As described above, the implementation in which the holes are formed on the side wall 200 and the implementation in which the side wall 200 may partially have the lower recessed area are to be further described later by referring to the figures such as FIG. 10A to FIG. 12, and the details are not described herein repeatedly.

As described above, in a case that the first contacts C11, C12, and C13 and the second contacts C21, C22, and C23 are respectively the plurality of first holes h11, h12, and h13 and the plurality of second holes h21, h22, and h23, the end a12 of the first supporting arm A1 of the first positioning member 410 away from the first baffle T1 may have a first protruding pin W1. The first protruding pin W1 may be inserted into the first hole h11, h12, or h13. Similarly, the end a22 of the second supporting arm A2 of the first positioning member 410 away from the first baffle T1 may have a second protruding pin W2. The second protruding pin W2 may be inserted into the second hole h21, h22, or h23. Therefore, the stability of the first supporting arm A1 and the second supporting arm A2 being detachably connected to the box body B such as the side wall 200 may further be enhanced by inserting the first protruding pin W1 into the first hole h11, h12, or h13 and inserting the second protruding pin W2 into the second hole h21, h22, or h23.

Figure 8:
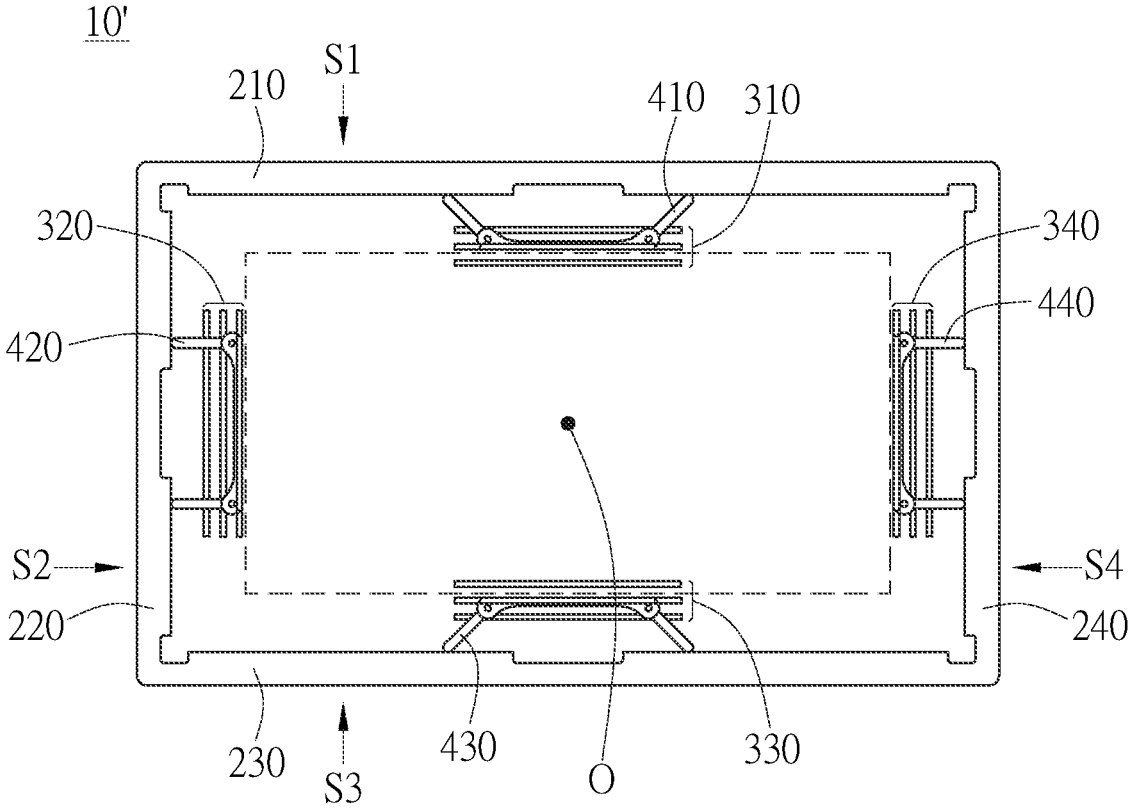
FIG. 8 is a schematic diagram of a loading box having a positioning member disposed and assembled on each of the four sides according to an embodiment of the present invention.

Next, referring to FIG. 8, according to the loading box 10' in some embodiments of the present invention, all of the sides such as the first side S1, the second side S2, the third side S3, and the fourth side S4 may be arranged in a similar manner as the first groove set 310 and the first positioning member 410 disposed corresponding to the first side S1. For example, the loading box 10' may have the first groove set 310 and the first positioning member 410 disposed along the first side S1, a second groove set 320 and a second positioning member 420 disposed along the second side S2, a third groove set 330 and a third positioning member 430 disposed along the third side S3, and a fourth groove set 340 and a fourth positioning member 440 disposed along the fourth side S4. As described above, the corresponding structure or principle should be understood and implemented with reference to the above description, and the details will not be described herein repeatedly.

According to an embodiment shown in FIG. 8, in a case that the positioning member and the groove set are disposed on each of the sides, the positioning member on each of the sides may be adjusted based on a size and a shape of the to-be-loaded object 1000 predetermined to be set. Therefore, the loading box 10' according to this embodiment may further have more variable adjustment flexibility, thereby improving the versatility and reusability of the loading box 10'.

In addition, according to other embodiments of the present invention, a plurality of positioning members may also be disposed along the same side, or no positioning member is disposed on some sides. As described above, person having ordinary skill in the art should be able to make various changes, adjustments, and combinations by referring to the above description, and the loading box of these implementations should all fall within the scope of the present invention and will not be further detailed herein.

Figure 9:
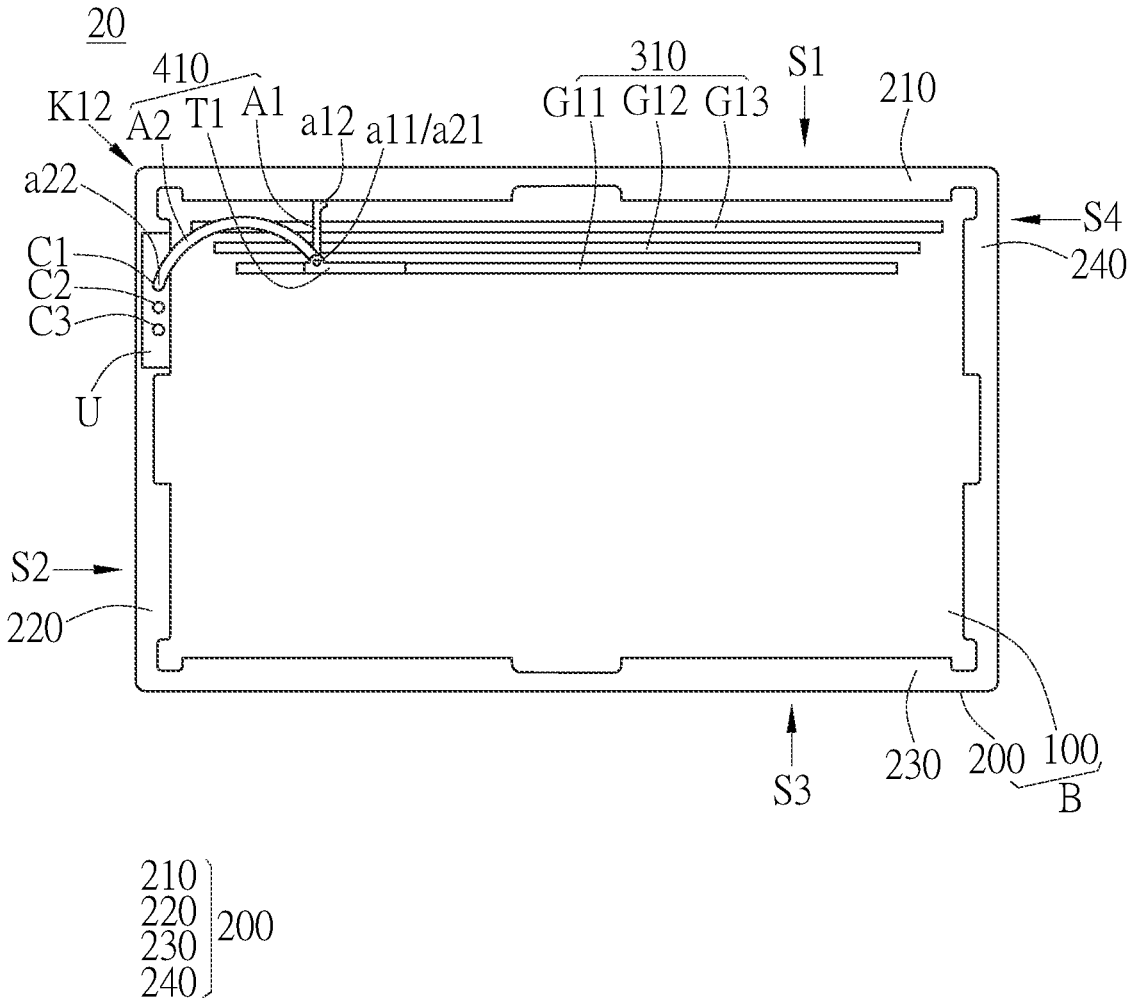
FIG. 9 is a schematic top view of a loading box assembled with a positioning member according to an embodiment of the present invention.

A loading box 20 according to yet another embodiment of the present invention is described below with reference to FIG. 9. Specifically, similar to the loading box 10, the loading box 20 may have a box body B including a base 100 and a side wall 200 protruding from the base 100 along the plurality of sides of the base 100, a first groove set 310 disposed on the base 100 along a first side S1 of sides S1, S2, S3, and S4, and a first positioning member 410 disposed corresponding to the first groove set 310. A first supporting arm A1 and a second supporting arm A2 of the first positioning member 410 may be respectively connected to a first baffle T1 and protrude from the first baffle T1 toward the side wall 200. For example, the first supporting arm A1 and the second supporting arm A2 of the first positioning member 410 may be respectively connected to a side of the first baffle T1 facing the side wall 200 and protrude from the first baffle T1 toward the side wall 200. As described above, according to this embodiment, the first supporting arm A1 of the first positioning member 410 may have an end a11 connected to the first baffle T1 and an end a12 connected to a box body B such as the side wall 200. The second supporting arm A2 of the first positioning member 410 may have an end a21 connected to the first baffle T1 and an end a22 connected to the box body B such as the side wall 200. As described above, a difference between the loading box 20 and the loading box 10 or 10' lies in that the end a12 of the first supporting arm A1 and the end a22 of the second supporting arm A2 of the first positioning member 410 in the loading box 20 away from the first baffle T1 may be detachably connected to the box body B respectively corresponding to the side walls 200 on different sides rather than the side wall 200 on the same side.

For example, the first side S1, the second side S2, the third side S3, and the fourth side S4 of the loading box 20 include the first side S1 and the second side S2 that intersect with each other. The side wall 200 includes a first side wall portion 210 located on the first side S1 and a second side wall portion 220 located on the second side S2. As described above, in a case that the first groove set 310 and the first positioning member 410 are disposed along the first side S1 correspondingly, the end a12 of the first supporting arm A1 and the end a22 of the second supporting arm A2 of the first positioning member 410 away from the first baffle T1 may be detachably connected to the first side wall portion 210 and the second side wall portion 220 respectively.

For example, the first baffle T1 of the first positioning member 410 may be disposed in any of the first groove G11, the first groove G12, or the first groove G13 in the first groove set 310 along the first side S1, and is relatively close to an end corner K12 at which the first side S1 intersects with the second side S2. The second supporting arm A2 of the first positioning member 410 may protrude from one end of the first baffle T1 of the first positioning member 410 relatively close to the end corner K12 or relatively close to the second side S2, so as to be detachably connected to the second side wall portion 220. Herein, in order to extend from the first baffle T1 disposed along the first side S1 to the second side wall portion 220 disposed along the second side S2, the second supporting arm A2 of the first positioning member 410 may be the arcuate supporting arm having the radian. For example, the second supporting arm A2 of the first positioning member 410 having the radian may be formed in such an implementation that a center of curvature is located on a side of the second supporting arm A2 opposite to the side wall 200. Therefore, the second supporting arm A2 of the first positioning member 410 may extend to be detachably connected to the second side wall portion 220.

According to some embodiments, the loading box may further include a connecting portion E corresponding to the first positioning member 410. In detail, the connecting portion E may have a plurality of contacts C1, C2, and C3 disposed along the second side wall portion 220. The end a22 of the second supporting arm A2 of the first positioning member 410 away from the first baffle T1 may be selectively connected to one of the contact C1, the contact C2, or the contact C3, so as to be detachably connected to the box body B corresponding to the second side wall portion 220. Similar to the first connecting portion E1 and the second connecting portion E2, number of the contacts C1, C2, and C3 corresponding to the second supporting arm A2 of the first positioning member 410 may be the same as the number of the first grooves G11, G12, and G13 in the first groove set 310 corresponding to the first positioning member 410.

Figure 10A:
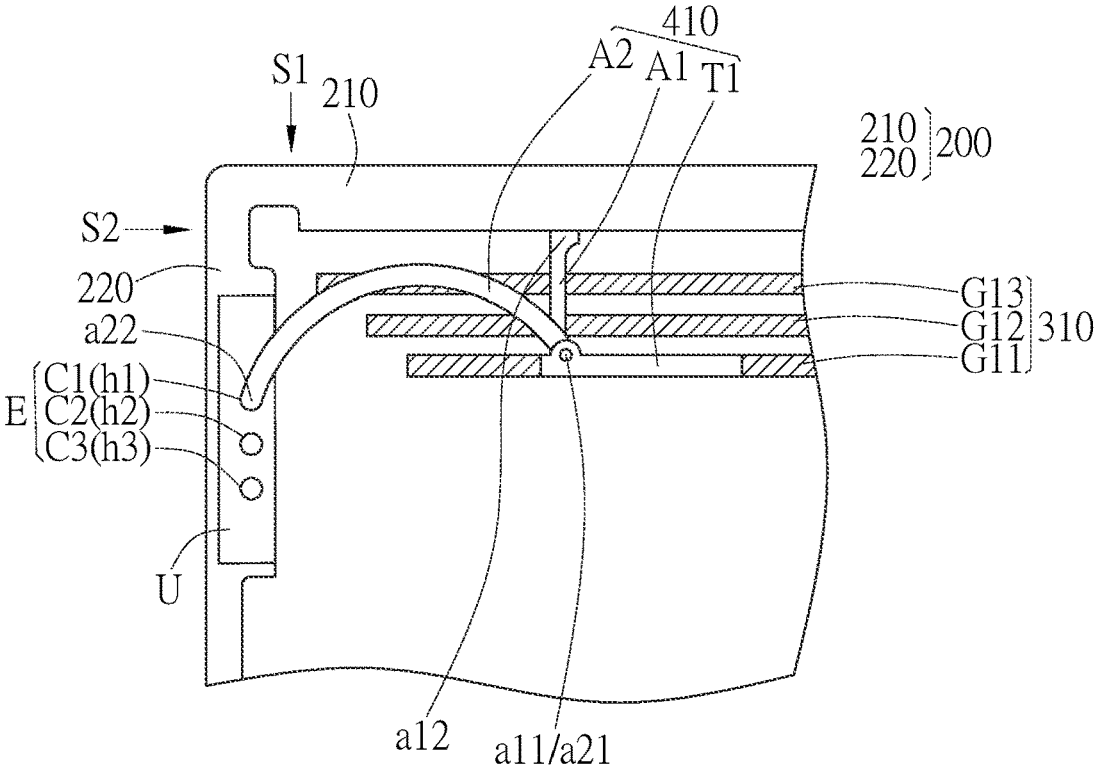
FIG. 10A to FIG. 10C are each a schematic top view showing adjustment of an arrangement position of a positioning member corresponding to a size of a to-be-loaded object according to an embodiment of the present invention.
Figure 10B:
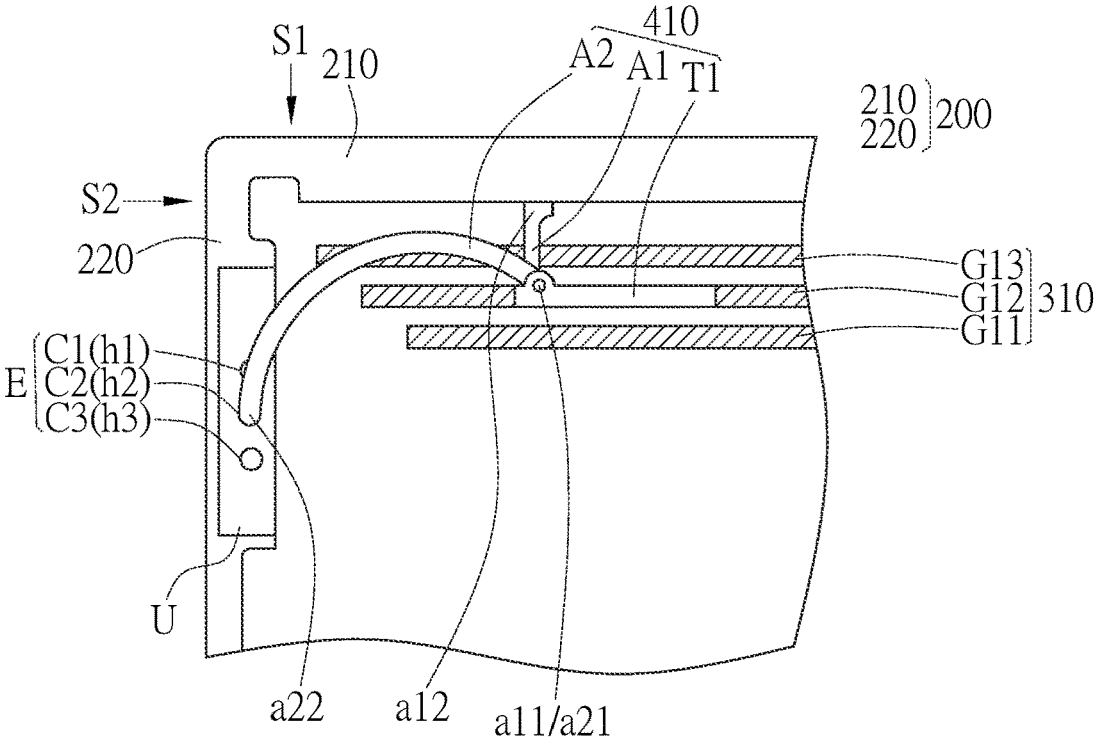
Figure 10C:
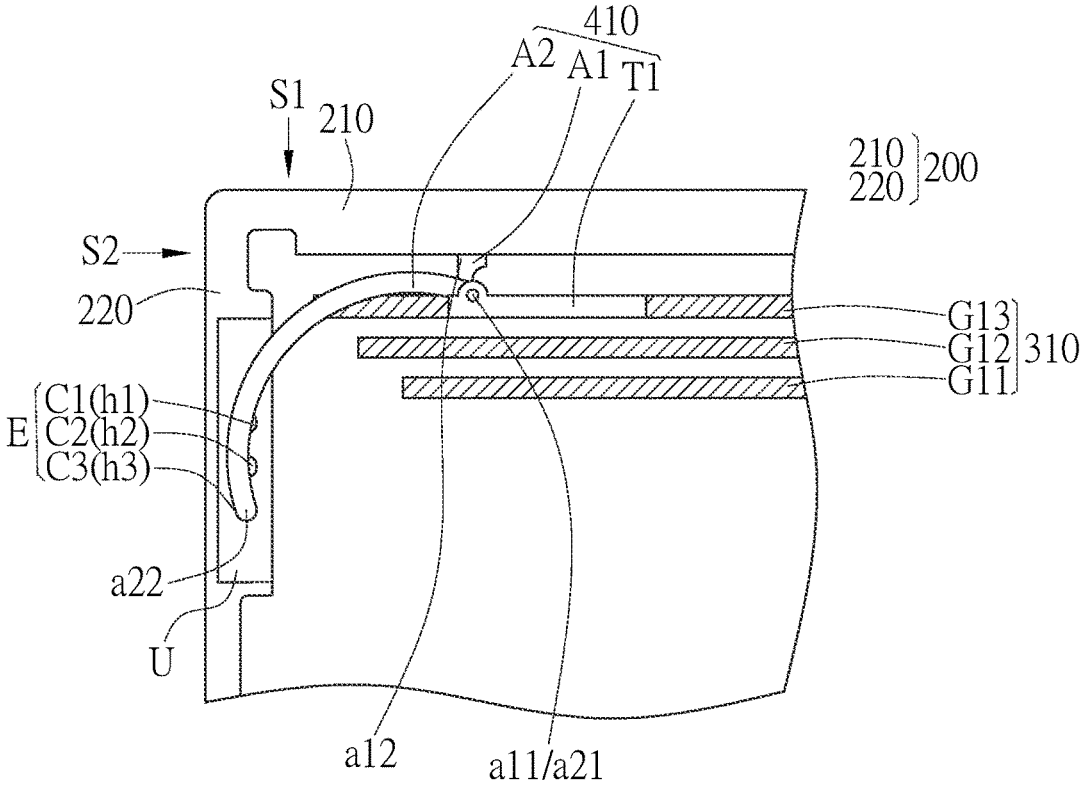

Further referring to FIG. 10A to FIG. 10C, based on the above architecture, if the first baffle T1 of the first positioning member 410 is inserted into one of the first groove G11, the first groove G12, or the first groove G13 in the first groove set 310 closer to the first side wall portion 210, the second supporting arm A2 of the first positioning member 410 is connected to one of the contact C1, the contact C2, or the contact C3 farther away from the first side wall portion 210. For example, as shown in FIG. 10A, when the first baffle T1 is inserted into the first groove G11 farthest away from the first side wall portion 210, the second supporting arm A2 of the first positioning member 410 may be connected to the contact C1 closest to the first side wall portion 210. When the first baffle T1 is inserted into the first groove G12, the second supporting arm A2 of the first positioning member 410 may be connected to the contact C2. When the first baffle T1 is inserted into the first groove G13 closest to the first side wall portion 210, the second supporting arm A2 of the first positioning member 410 may be connected to the contact C3 farthest away from the first side wall portion 210. As described above, a connection position of the protruded second supporting arm A2 may be correspondingly adjusted based on the groove into which the first baffle T1 is inserted, so as to adjust a positioning position of the first positioning member 410 and the accommodating space of the defined to-be-loaded object.

Further, similar to the first contacts C11, C12, and C13 or the second contacts C21, C22, and C23, the contacts C1, C2, and C3 may be, for example, a plurality of holes h1, h2, and h3. The holes h1, h2, and h3 may be, for example, respectively formed and opened on the side wall 200 away from the base 100 along the side wall 200. Specifically, the holes h1, h2, and h3 may be, for example, formed on a part of a top surface of the side wall 200, and may have upward openings for the protruding pin to be inserted. For example, the side wall 200 may partially have a lower recessed area U. The holes h1, h2, and h3 may be formed on the lower recessed area U and may be for the end a22 of the second supporting arm A2 to be inserted. As described above, the end a22 of the second supporting arm A2 of the first positioning member 410 away from the first baffle T1 may have the protruding pin to be inserted into the hole h1, h2, or h3. In this way, the second supporting arm A2 can be connected to the side wall 200 more firmly. As described above, these contents are the same or similar to the first protruding pin W1 and the second protruding pin W2 described above, or can be understood or analogized from the description of the above embodiments, and the details will not be described herein again.

According to some embodiments, when the side wall 200 is provided with the recessed area U corresponding to the connecting portion such as the connecting portion E, a space for a supporting arm such as the second supporting arm A2 to rotate and move may be provided. In this way, the interference between the supporting arm such as the second supporting arm A2 and the side wall 200 can be reduced or avoided.

Figure 11:
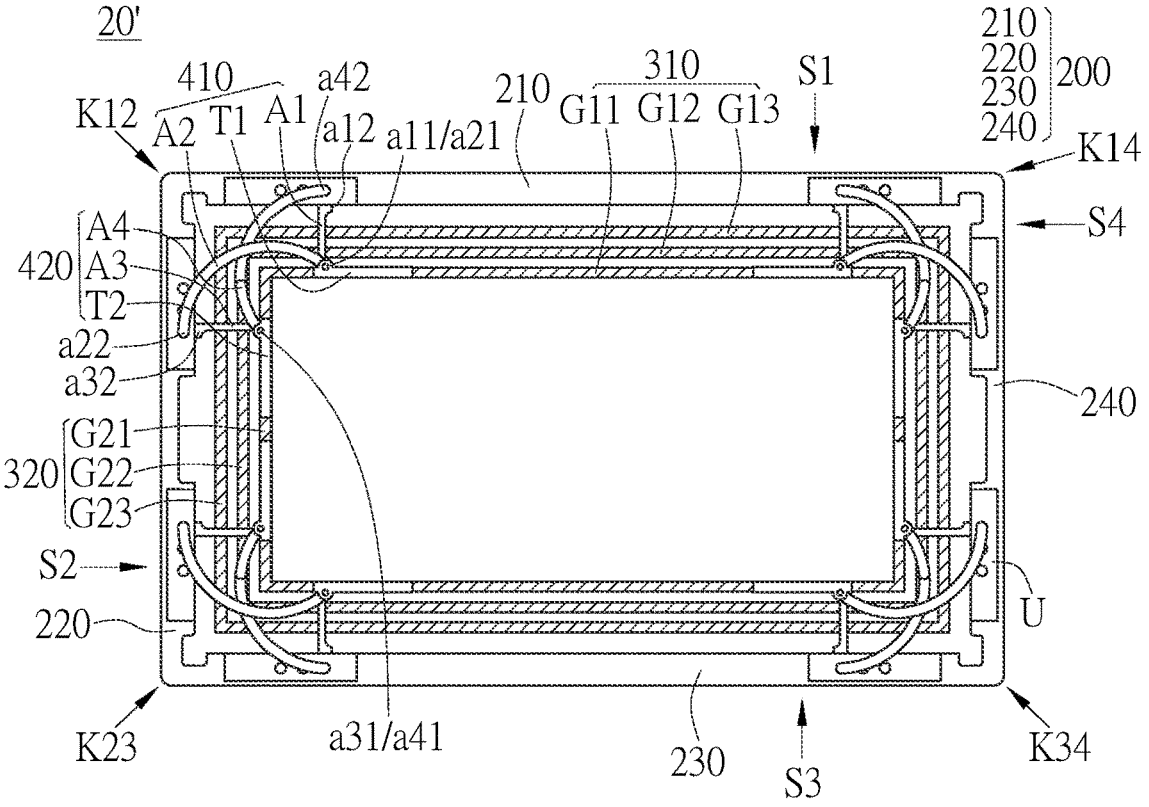
FIG. 11 is a schematic diagram of a loading box disposed and assembled with a plurality of positioning members according to an embodiment of the present invention.

Next, referring to FIG. 11, in order to increase the range of applicable sizes or shapes of to-be-loaded objects, a loading box 20' according to yet another embodiment of the present invention may have a plurality of positioning members similar to the first positioning member 410 of the above loading box 20. For example, as shown in FIG. 11, the loading box 20' may have eight positioning members. A combination of two relative positioning members is disposed corresponding to each of the end corners K12, K14, K34, and K23. As described above, the first positioning member 410 and the second positioning member 420 at one end corner K12 are described below. The arrangement and operation of the positioning member matching each of the other end corners K14, K34, and K23 can be implemented in the same or similar manner, which is not additionally described.

As described above, at the end corner K12 of which the first side S1 and the second side S2 intersects with each other may be provided with the first groove set 310 and the first positioning member 410 disposed along the first side S1, and may be provided with the second groove set 320 and the second positioning member 420 disposed along the second side S2. Specifically, the second groove set 320 may have a plurality of second grooves G21, G22, and G23, and is disposed on the base 100 along the second side S2. In addition, the second positioning member 420 may be disposed corresponding to the second groove set 320, and includes a second baffle T2, a third supporting arm A3, and a fourth supporting arm A4. The configuration of the first positioning member 410 is the same or similar to that described above with reference to FIG. 9, and the details will not be described herein again. In addition, similar to the first positioning member 410 described above, the second baffle T2 of the second positioning member 420 is detachably inserted into one of the second groove G21, the second groove G22, or the second groove G23 in the second groove set 320. Accordingly, the third supporting arm A3 and the fourth supporting arm A4 may be respectively connected to the second baffle T2 and protrude from the second baffle T2 toward the side wall 200.

As shown in FIG. 11, for example, when the third supporting arm A3 of the second positioning member 420 may have an end a31 connected to the second baffle T2 and an end a32 connected to the side wall 200. The fourth supporting arm A4 of the second positioning member 420 may have an end a41 connected to the second baffle T2 and an end a42 connected to the side wall 200. Similar to the first positioning member 410, the fourth supporting arm A4 of the second positioning member 420 may also be an arcuate supporting arm having a radian. A center of curvature of the fourth supporting arm A4 having a radian is located on a side of the fourth supporting arm A4 opposite to the side wall 200. Therefore, the fourth supporting arm A4 of the second positioning member 420 may extend to the corresponding first side wall portion 210 to be detachably connected to the box body B. Therefore, the end a32 of the third supporting arm A3 and the end a42 of the fourth supporting arm A4 of the second positioning member 420 away from the second baffle T2 can be detachably connected to the box body B corresponding to the second side wall portion 220 and the first side wall portion 210 respectively. For example, the end a32 of the third supporting arm A3 and the end a42 of the fourth supporting arm A4 of the second positioning member 420 away from the second baffle T2 may be detachably connected to the second side wall portion 220 and the first side wall portion 210 respectively. As described above, based on this architecture, the second supporting arm A2 of the first positioning member 410 may intersect with the fourth supporting arm A4 of the second positioning member 420, so as to further strengthen the supportability and disperse the stress more effectively.

In addition, according to some embodiments, when the arcuate supporting arm rotates by a limited rotation amplitude relative to the baffle or cannot rotate, or in a case that the space configuration is allowed, the relative matching manner of the groove into which the baffle of the positioning member is inserted and the contact is different from (for example, opposite to) that described above in FIG. 10A to FIG. 10C. For example, as shown in FIG. 11, if the first baffle T1 of the first positioning member 410 is inserted into one of the first groove G11, the first groove G12, or the first groove G13 in the first groove set 310 farther away from the first side wall portion 210, the second supporting arm A2 of the first positioning member 410 is connected to one of the contacts farther away from the first side wall portion 210. However, this is merely an example. According to other embodiments, implementations of the plurality of positioning members shown in FIG. 11 may also be the same as that shown in FIG. 10A to FIG. 10C. If the first baffle T1 of the first positioning member 410 is inserted into one of the first groove G11, the first groove G12, or the first groove G13 in the first groove set 310 closer to the first side wall portion 210, the second supporting arm A2 of the first positioning member 410 is connected to one of the contacts farther away from the first side wall portion 210. As described above, according to the present invention, the matching manner of the insertion grooves and the contacts can vary in various ways.

Next, an exemplary configuration and operation for defining accommodating space and buffering and transmitting stress according to this embodiment are described with reference to FIG. 12 in which a part of the end corner K12 in FIG. 11 is enlarged.

Figure 12:
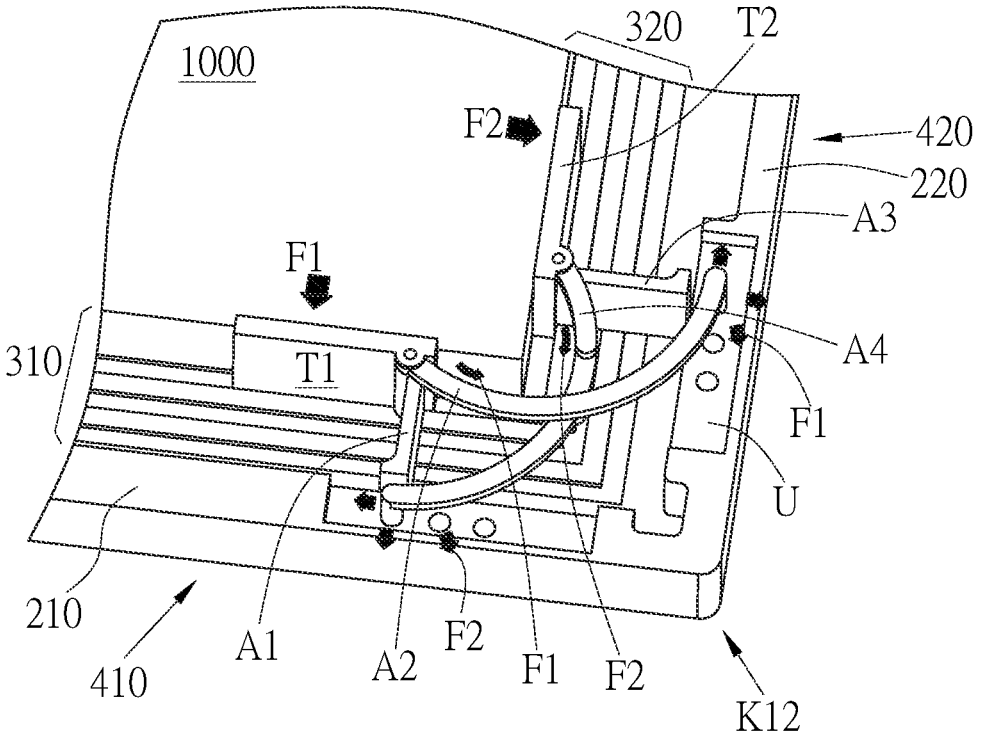
FIG. 12 is a schematic diagram showing transmission and dispersion of stress on a loading box by using an arcuate supporting arm having a radian according to an embodiment of the present invention.

As shown in FIG. 12 of which an enlarged schematic three-dimensional diagram of the end corner K12 is shown, the first baffle T1 of the first positioning member 410 and the second baffle T2 of the second positioning member 420 are inserted into the first groove set 310 and the second groove set 320 respectively, so as to define the accommodating space for placing the to-be-loaded object 1000. As described above, when the loaded object 1000 is subjected to the stress impact, part of the stress can be transmitted along the second supporting arm A2 of the first positioning member 410 (for example, a transmission direction F1), and can be absorbed or transmitted to the second side wall portion 220 due to the elasticity of the second supporting arm A2 of the first positioning member 410 having a radian, so as to reduce or prevent the stress from impacting the loaded object 1000. In addition, similarly, part of the stress can be transmitted along the fourth supporting arm A4 of the second positioning member 420 (for example, a transmission direction F2), and can be absorbed or transmitted to the first side wall portion 210 due to the elasticity of the fourth supporting arm A4 of the second positioning member 420 having a radian, so as to reduce or prevent the stress from impacting the loaded object 1000.

Figure 13:
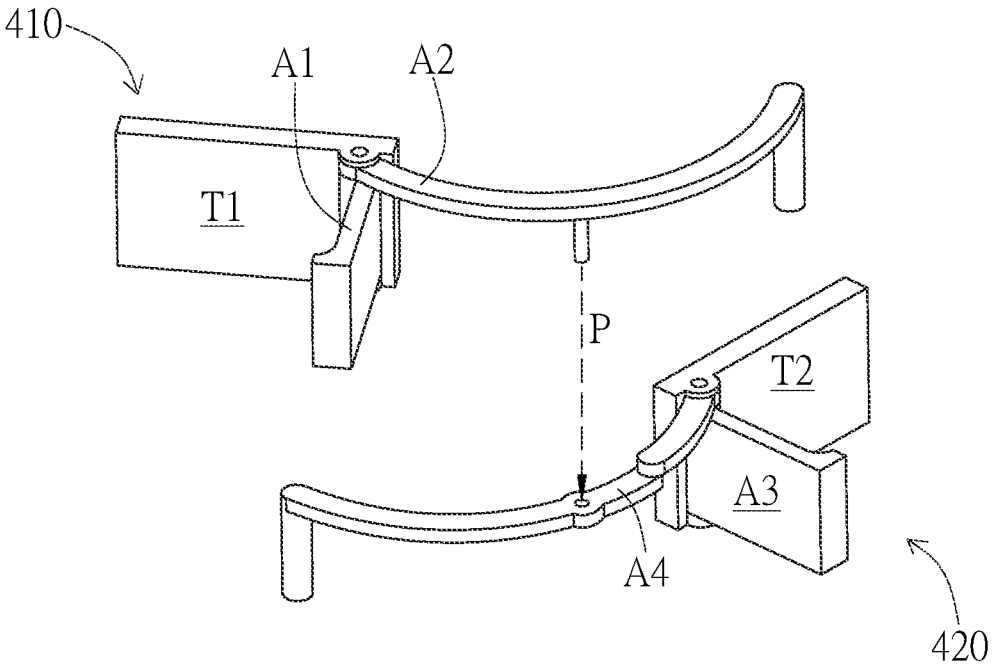
FIG. 13 is a schematic diagram showing mutual snap-fitting of arcuate supporting arms of positioning members on two sides disposed corresponding to an end corner according to an embodiment of the present invention.

As described above, the second supporting arm A2 of the first positioning member 410 may intersect with the fourth supporting arm A4 of the second positioning member 420. According to some embodiments of the present invention, as shown in FIG. 13, in order to improve the positioning accuracy or positioning stability, and improve the bearing capacity when the loaded object is subjected to the stress impact, the second supporting arm A2 of the first positioning member 410 and the fourth supporting arm A4 of the second positioning member 420 in the above implementations may further be snap-fitted to each other at a node P where the second supporting arm A2 and the fourth supporting arm A4 intersect with each other or have a structure for the second supporting arm A2 and the fourth supporting arm A4 to slide relative to each other. For example, the second supporting arm A2 of the first positioning member 410 may have a protrusion like an axis. The corresponding fourth supporting arm A4 of the second positioning member 420 may have a round hole bearing structure for inserting the axis extended from the second supporting arm A2, and the like.

Figure 14A:
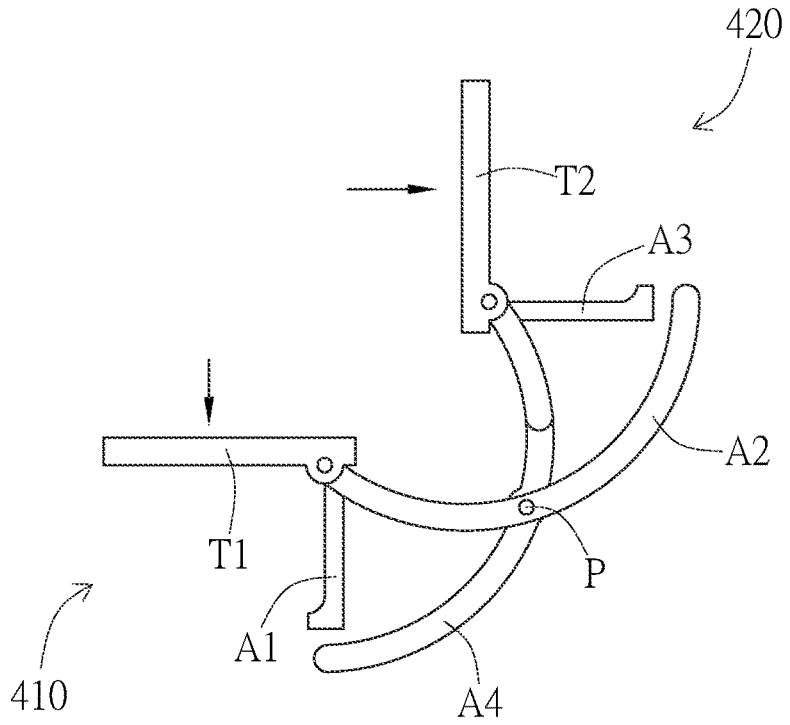
FIG. 14A and FIG. 14B are each a schematic diagram showing size adjustment of an accommodating space based on a node by different positioning members mutually snap-fitted to each other according to an embodiment of the present invention.
Figure 14B:
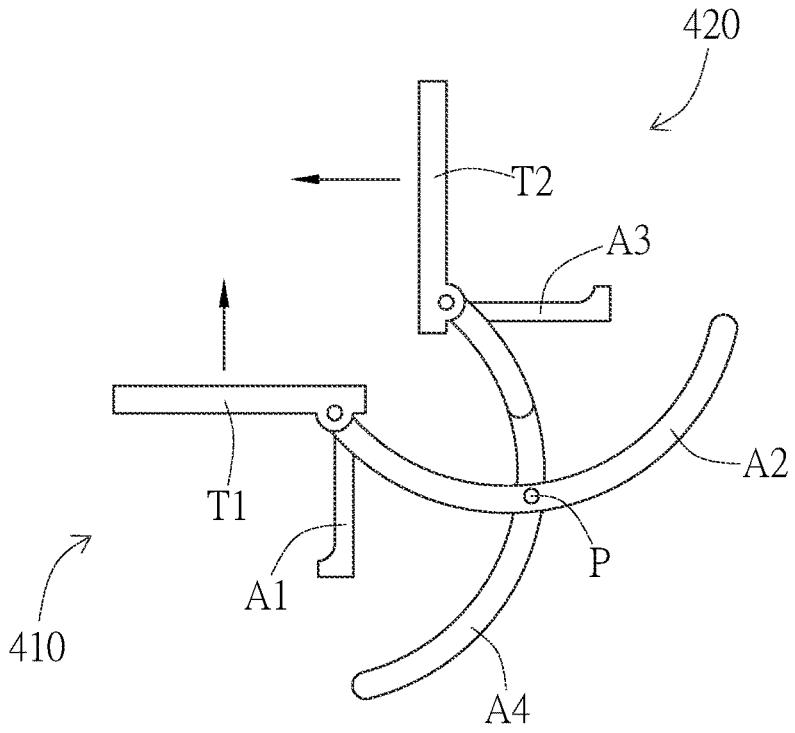

Further referring to FIG. 14A and FIG. 14B, based on this structure, the second supporting arm A2 of the first positioning member 410 and the fourth supporting arm A4 of the second positioning member 420 may be rotatable relative to the node P. Therefore, the positioning accuracy or positioning stability is improved and the bearing capacity under stress impact is improved through the relative engagement with each other, and the second supporting arm A2 and the fourth supporting arm A4 can still be rotated to be unfolded or folded correspondingly, so as to adjust the accommodating space of the to-be-loaded object defined by the first positioning member 410 and the second positioning member 420. For example, as shown in FIG. 14A, the first baffle T1 and the second baffle T2 can be rotated with respect to the node P to separate, so that the accommodating space for the to-be-loaded object becomes larger. Alternatively, as shown in FIG. 14B, the first baffle T1 and the second baffle T2 can be rotated with respect to the node P to be clamped, so that the accommodating space for the to-be-loaded object is reduced. As described above, the accommodating space defined by the first baffle T1 and the second baffle T2 can be opened and closed by correspondingly adjusting the rotation amplitude of the arcuate supporting arm and the corresponding contact.

Figure 14C:
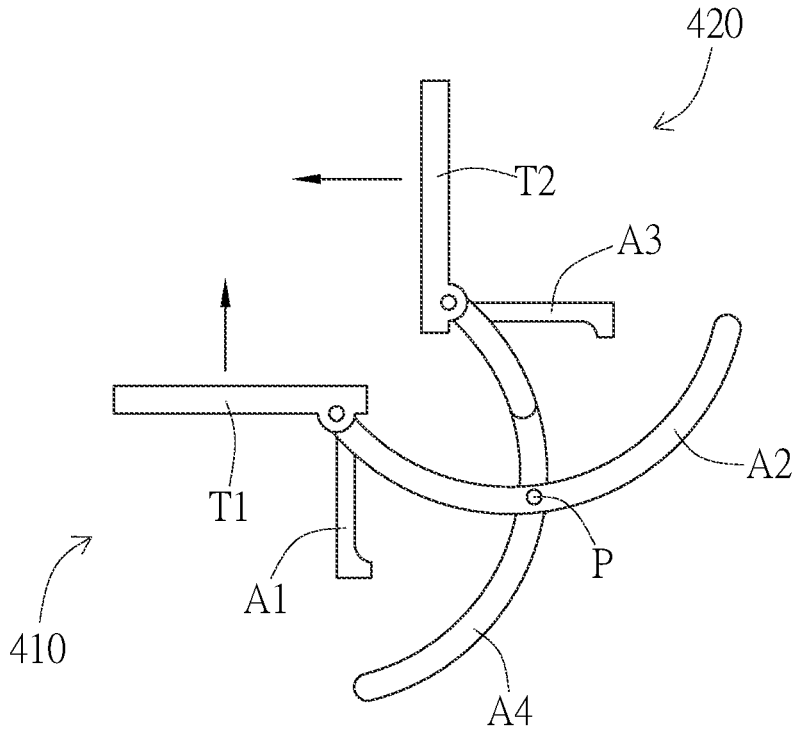
FIG. 14C is a schematic diagram of different implementations of a tail end of a supporting arm according to another embodiment of the present invention.

In the above embodiment, although FIG. 14A and FIG. 14B both show that when the first supporting arm A1 and the third supporting arm A3 are substantially perpendicular to the first baffle T1 and the second baffle T2 respectively, a tail end of the first supporting arm A1 or the third supporting arm A3 has a tail end parallel to the first baffle T1 or the second baffle T2 and protruding toward the inside of the first baffle T1 or the second baffle T2, but the present invention is not limited thereto. As described above, according to other embodiments, as shown in FIG. 14C, when the first supporting arm A1 and the third supporting arm A3 are substantially perpendicular to the first baffle T1 and the second baffle T2 respectively, the tail end of the first supporting arm A1 or the third supporting arm A3 may also have a tail end parallel to the first baffle T1 or the second baffle T2 and protruding away from inside of the first baffle T1 or the second baffle T2. In addition, in a case that the first supporting arm A1 or the third supporting arm A3 is capable to be firmly abutted against or connected, the tail end of the first supporting arm A1 or the third supporting arm A3 in other embodiments may not have a corresponding tail end structure.

According to some embodiments, after the first positioning member 410 and the second positioning member 420 are mutually snap-fitted to each other, the first positioning member 410 and the second positioning member 420 may be mounted to the box body together. In addition, according to some embodiments, one of the first positioning member 410 or the second positioning member 420 may be mounted to the box body first, and then the other one is mounted to the box body, so that the second supporting arm A2 of the first positioning member 410 and the fourth supporting arm A4 of the second positioning member 420 are snapped relative to the node P. However, according to the loading box in the embodiments of the present invention, the order and process of assembling can be freely adjusted according to the actual situation, and are not limited to the implementations described in detail herein.

Next, the configuration of the first supporting arm A1 of the first positioning member 410 is further described. The third supporting arm A3 of the second positioning member 420 is also configured in the same or similar manner, and the details will not be described in detail.

Figure 15:
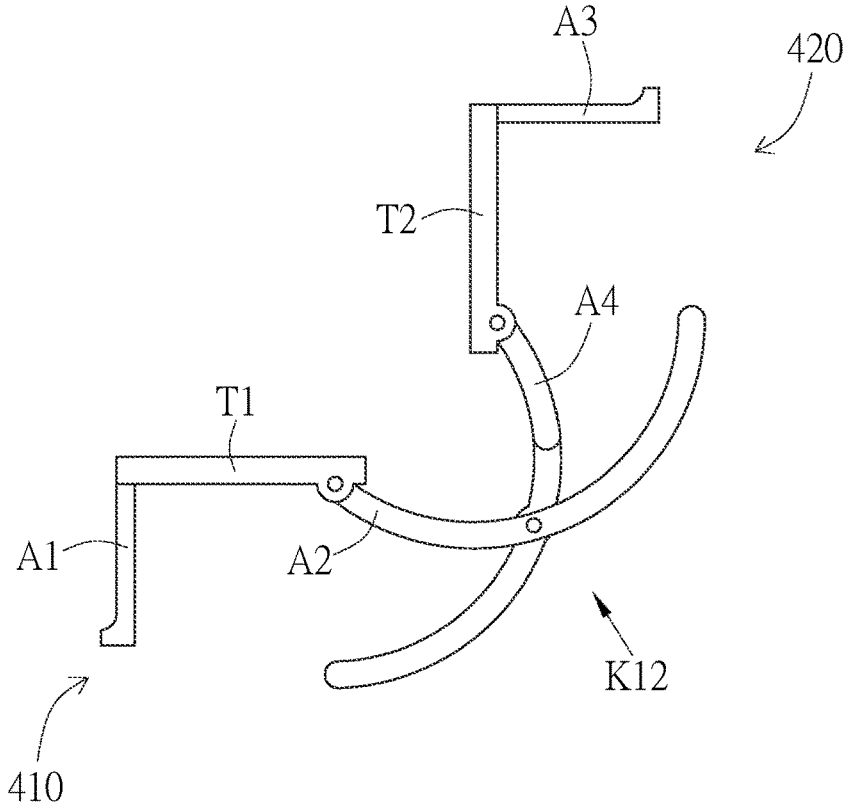
FIG. 15 is a schematic diagram of a first supporting arm and a second supporting arm protruding from an opposite side of a baffle according to an embodiment of the present invention.

As shown in the above figures, according to some embodiments of the present invention, the first supporting arm A1 and the second supporting arm A2 of the first positioning member 410 may substantially extend from an end of the first baffle T1 correspondingly close to the end corner K12. However, according to other embodiments, as shown in FIG. 15, the first supporting arm A1 and the second supporting arm A2 of the first positioning member 410 may substantially protrude from an end of the first baffle T1 opposite to the end corner K12 and an end of the first baffle T1 close to the end corner K12 respectively. That is, the present invention does not limit a fulcrum at which the first supporting arm A1 and the second supporting arm A2 protrude relative to the first baffle T1, and in the following, the implementation that the first supporting arm A1 and the second supporting arm A2 of the first positioning member 410 both protrude from the end of the first baffle T1 close to the end corner K12 is used for description.

Figure 16:
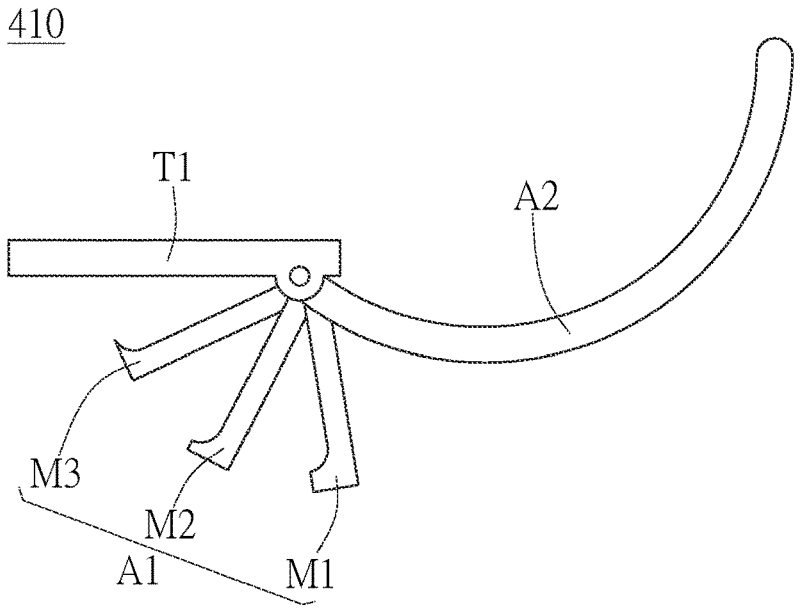
FIG. 16 is a schematic diagram of a first supporting arm having a plurality of brackets that are independently rotatable and have different lengths according to an embodiment of the present invention.

As described above, according to this embodiment, as shown in FIG. 11, the first supporting arm A1 of the first positioning member 410 may be correspondingly detachably connected to the first side wall portion 210 corresponding to the first baffle T1 of the first positioning member 410 disposed along the first side S1. As described above, due to the difference in the groove for arrangement, a spacing between the first baffle T1 and the first side wall portion 210 also changes accordingly. In view of this, the first supporting arm A1 of the first positioning member 410 may be any structure having an adjustable length. For example, the first supporting arm A1 of the first positioning member 410 may be a telescopic supporting arm. Alternatively, as shown in FIG. 16, the first supporting arm A1 may have a plurality of brackets M1, M2, and M3 having different lengths, protruding from the first baffle T1, and independently rotatable relative to the first baffle T1. As described above, the number of the brackets M1, M2, and M3 is the same as the number of the first grooves G11, G12, and G13 in the first groove set 310. That is, the first grooves G11, G12, and G13 into which the first positioning member 410 is inserted respectively correspond to the brackets M1, M2, and M3.

Specifically, referring to FIG. 16 together with FIG. 11, a length of a different one of the bracket M1, the bracket M2, or the bracket M3 of the first supporting arm A1 may respectively correspond to a spacing between one of the first groove G11, the first groove G12, or the first groove G13 and the first side wall portion 210, and one of the bracket M1, the bracket M2, or the bracket M3 of the first supporting arm A1 is rotated out from the first baffle T1 to be detachably connected to the first side wall portion 210. For example, when the first baffle T1 of the first positioning member 410 is inserted into the first groove G11, the bracket M1 of the first supporting arm A1 having the longest length may be selectively turned out to abut against the first side wall portion 210. Alternatively, when the first baffle T1 of the first positioning member 410 is inserted into the third groove G13, the bracket M3 of the first supporting arm A1 having the shortest length may be selectively turned out to abut against the first side wall portion 210.

Figure 17:
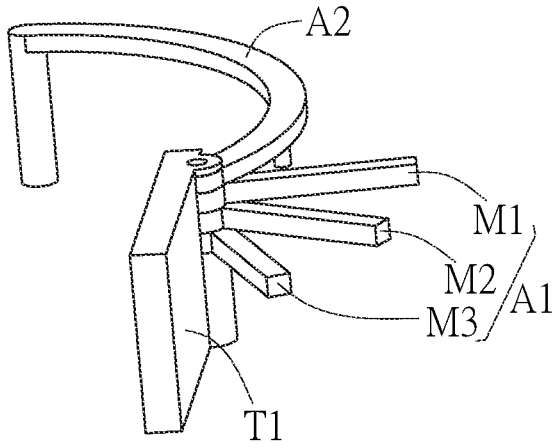
FIG. 17 is a schematic diagram of a plurality of brackets formed side by side according to an embodiment of the present invention.
Figure 18:
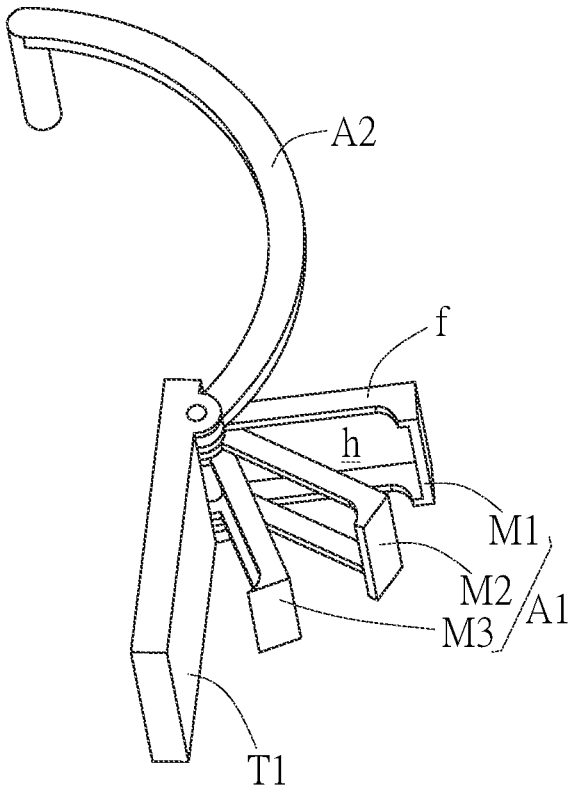
FIG. 18 is a schematic diagram of a plurality of brackets formed into a flip-over structure according to an embodiment of the present invention.

Next, referring to FIG. 17, in order to implement the above brackets M1, M2, and M3 having different lengths, according to an embodiment, the brackets M1, M2, and M3 may be formed as a pillar-type structure having different lengths and arranged side by side on the first baffle T1. In addition, referring to FIG. 18, according to still another embodiment, the brackets M1, M2, and M3 may be formed as a flip-over structure having different lengths and mutually received on the first baffle T1. For example, one or more of the brackets M1, M2, and M3 may be respectively formed into a hollow frame shape f, to let the shorter bracket M3 in the brackets M1, M2, and M3 to be placed in a hollow area h of the frame shape f of the longer bracket M1 in the brackets M1, M2, and M3 when received in the first baffle T1. However, the implementations shown herein are merely examples, and the structure that can be used to realize the adjustable length of the first supporting arm A1 is not limited thereto. In addition, according to some embodiments, grooves may further be formed on a side surface of the first baffle T1 connected to the plurality of brackets M1, M2, and M3, so as to accommodate the brackets M1, M2, and M3 when the brackets M1, M2, and M3 are not turned out, but the other embodiments of the present invention are not limited thereto.

Figure 19:
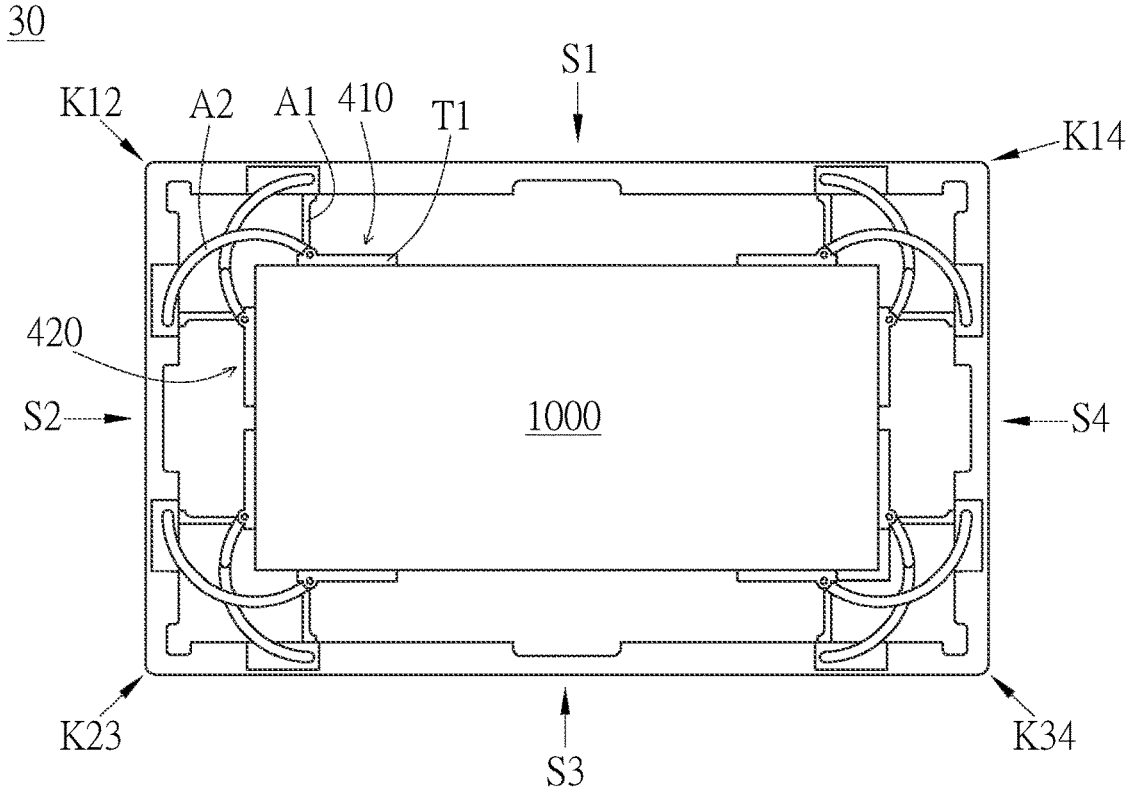
FIG. 19 is a schematic top view of a loading box assembled with positioning members according to an embodiment of the present invention.

A loading box 30 according to still another embodiment of the present invention is described below with reference to FIG. 19.

In detail, the loading box 30 may have a configuration of a plurality of positioning members similar to the loading box 20' shown in FIG. 11. Two supporting arms of each positioning member may be connected to side wall portions of different sides intersecting to each other. However, according to this embodiment, a difference between the loading box 30 and the loading box 20' shown in FIG. 11 is that the loading box 30 may not have a groove set structure, and therefore an arranged position of the positioning member does not change with the inserted groove. Therefore, according to this embodiment, the first supporting arm A1 and the second supporting arm A2 of the positioning member, such as the first positioning member 410, may not be rotatable relative to the first baffle T1. For example, the first supporting arm A1, the second supporting arm A2, and the first baffle T1 of the positioning member, such as the first positioning member 410, may actually be integrally formed. Further, according to other embodiments, adjacent positioning members disposed corresponding to the same end corner and having arcuate supporting arms intersecting with each other may also be integrally formed, but the present invention is not limited thereto.

As described above, according to this embodiment, the remaining positioning members may be configured similarly to the first positioning member 410. In addition, similar to the first positioning member 410 and the second positioning member 420 described previously with reference to FIG. 11, according to this embodiment, the first positioning member 410 configured corresponding to the first side S1 and the second positioning member 420 configured corresponding to the second side S2 may also be disposed relative to the end corner K12. As described above, corresponding to the end corner K12, the second supporting arm A2 of the first positioning member 410 may intersect with the fourth supporting arm A4 of the second positioning member 420. Similar configurations may also be performed corresponding to other end corners K14, K23, and K34.

Figure 20:
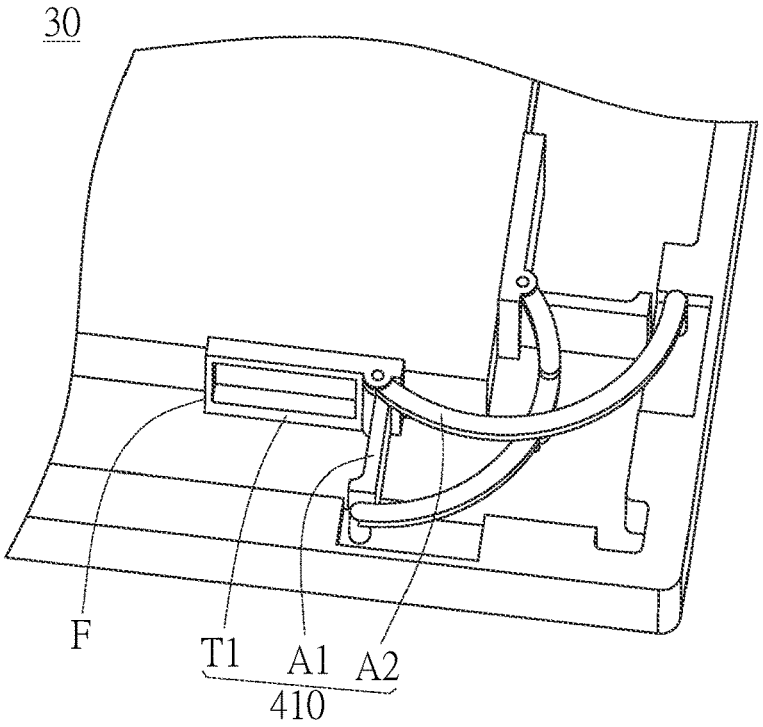
FIG. 20 is a schematic diagram of a baffle of a positioning member formed into a frame shape according to an embodiment of the present invention.

Further, referring to FIG. 20, according to this embodiment, in order to reduce the materials or reduce the weight of the loading box 30, the first baffle T1 may also be at least partially hollowed-out as described in the foregoing embodiment. However, the present invention is not limited thereto, and the implementations or structures described in the above embodiments without conflicting with each other can be freely applied to combine with each other. For example, the number of positioning members can be selectively increased or decreased, a contact may/may not be required to assist positioning of the supporting arm, the arcuate supporting arm may abut against a side of the side wall rather than an upper surface of the body of the side wall to be connected to the box body, or different implementations of the first supporting arm A1 and the second supporting arm A2 may be selectively used. As described above, other embodiments according to the present invention are not limited to the combination implementations described in detail herein.

Based on the above, the loading box according to the embodiments of the present invention is applicable to the to-be-loaded object of an increased number of sizes and shapes, thereby enhancing the shareability. In addition, since the molding and production of the loading box for new objects are reduced or avoided, the operation cost and the operation time can be reduced. Further, since there is no need to paste or cut the structure of the loading box, the operation can be relatively simplified and may be applicable to an operating machine or an automated process. In addition, the detachable positioning member and the corresponding box body of the loading box may also be reused correspondingly, thereby reducing the required resources and costs and the generation of waste. Therefore, according to the loading box in the embodiments of the present invention, circular economy and an environment-friendly industry can be promoted.

The above are merely some exemplary embodiments of the present invention. It should be noted that various variations and amendments may be made to the present invention without departing from the spirit and the principle of the present invention. A person of ordinary skill in the art should understand that the present invention is defined by the claims attached, and in a case of complying with the intention of the present invention, various possible changes such as substitutions, combinations, modifications and diversions all fall within the scope of the present invention as defined in the claims attached.

REFERENCE NUMERALS

10, 10', 20, 20', 30: loading box
100: base
200: side wall
210: first side wall portion
220: second side wall portion
230: third side wall portion
240: fourth side wall portion
310: first groove set
320: second groove set
330: third groove set
340: fourth groove set
410: first positioning member
420: second positioning member
430: third positioning member
440: fourth positioning member
1000: object
B: box body
G11, G12, G13: first groove
G21, G22, G23: second groove
T1: first baffle
T2: second baffle
T10: buffer plate
A1: first supporting arm
A2: second supporting arm
A3: third supporting arm
A4: fourth supporting arm
S1: first side
S2: second side
S3: third side
S4: fourth side
a11, a12, a21, a22, a31, a32, a41, a42: end
E1: first connecting portion
E2: second connecting portion
E: connecting portion
C11, C12, C13: first contact
C21, C22, C23: second contact
C1, C2, C3: contacts
h11, h12, h13: first hole
h21, h22, h23: second hole
h1, h2, h3: hole
W1: first protruding pin
W2: second protruding pin
F: hollow frame
f: frame shape
H: hollowed-out area
h: hollow area
O: center
K12, K14, K34, K23: end corner
F1, F2: direction
M1, M2, M3: bracket
P: node
U: recessed area

What is claimed is:

1. A loading box, comprising:
a box body, having a base and a side wall protruding from the base along a plurality of sides of the base;
a first groove set, having a plurality of first grooves and disposed on the base along a first side of the sides; and
a first positioning member, disposed corresponding to the first groove set and comprising:
a first baffle, detachably inserted into one of the first grooves in the first groove set; and
a first supporting arm and a second supporting arm, respectively connected to the first baffle and protruding from the first baffle toward the side wall, wherein
one ends of the first supporting arm and the second supporting arm of the first positioning member away from the first baffle are detachably connected to the box body.

2. The loading box of claim 1, further comprising a buffer plate, wherein
the buffer plate is made of a material having a rigidity less than that of the first baffle, and is attached to a side of the first baffle facing a center of the base.

3. The loading box of claim 1, wherein the first baffle is at least partially hollowed-out.

4. The loading box of claim 1, wherein the first supporting arm and/or the second supporting arm of the first positioning member are/is rotatable relative to the first baffle.

5. The loading box of claim 1, wherein at least one of the first supporting arm or the second supporting arm of the first positioning member is an arcuate supporting arm having a radian.

6. The loading box of claim 1, wherein the side wall comprises a first side wall portion located on the first side, and
the ends of the first supporting arm and the second supporting arm of the first positioning member away from the first baffle are detachably connected to the first side wall portion.

7. The loading box of claim 6, further comprising:
a first connecting portion, having a plurality of first contacts disposed along the first side wall portion; and
a second connecting portion, having a plurality of second contacts disposed along the first side wall portion, wherein
the end of the first supporting arm of the first positioning member away from the first baffle is selectively connected to one of the first contacts, and the end of the second supporting arm of the first positioning member away from the first baffle is selectively connected to one of the second contacts.

8. The loading box of claim 7, wherein a number of the first contacts is the same as a number of the first grooves in the first groove set.

9. The loading box of claim 7, wherein the first contacts and the second contacts are respectively a plurality of first holes and a plurality of second holes, the first holes and the second holes are formed on the base or the side wall, and
the end of the first supporting arm of the first positioning member away from the first baffle has a first protruding pin to be inserted into one of the first holes, and the end of the second supporting arm of the first positioning member away from the first baffle has a second protruding pin to be inserted into one of the second holes.

10. The loading box of claim 1, wherein the sides comprise the first side and a second side intersecting with the first side, the side wall comprises a first side wall portion located on the first side and a second side wall portion located on the second side, the ends of the first supporting arm and the second supporting arm of the first positioning member away from the first baffle are detachably connected to the first side wall portion and the second side wall portion respectively, the second supporting arm of the first positioning member is an arcuate supporting arm having a radian, and a center of curvature of the second supporting arm having the radian is located on a side of the second supporting arm opposite to the side wall.

11. The loading box of claim 10, further comprising:

a connecting portion, having a plurality of contacts disposed along the second side wall portion, wherein the end of the second supporting arm of the first positioning member away from the first baffle is selectively connected to one of the contacts.

12. The loading box of claim 11, wherein a number of the contacts is the same as a number of the first grooves in the first groove set, and if the first baffle of the first positioning member is inserted into one of the first grooves in the first groove set closer to the first side wall portion, the second supporting arm of the first positioning member is connected to one of the contacts farther away from the first side wall portion.

13. The loading box of claim 11, wherein the contacts are a plurality of holes, the holes are formed on the base or the side wall respectively, and the end of the second supporting arm of the first positioning member away from the first baffle has a protruding pin to be inserted into one of the holes.

14. The loading box of claim 10, further comprising:

a second groove set, having a plurality of second grooves and disposed on the base along the second side; and a second positioning member, disposed corresponding to the second groove set and comprising:

a second baffle, detachably inserted into one of the second grooves in the second groove set; and a third supporting arm and a fourth supporting arm, respectively connected to the second baffle and protruding from the second baffle toward the side wall, wherein one ends of the third supporting arm and the fourth supporting arm of the second positioning member away from the second baffle are detachably connected to the second side wall portion and the first side wall portion respectively, the fourth supporting arm of the second positioning member is an arcuate supporting arm having a radian, a center of curvature of the fourth supporting arm having the radian is located on a side of the fourth supporting arm opposite to the side wall, and the second supporting arm of the first positioning member intersects with the fourth supporting arm of the second positioning member.

15. The loading box of claim 14, wherein the second supporting arm of the first positioning member and the fourth supporting arm of the second positioning member are snap-fitted to each other at a node where the second supporting arm and the fourth supporting arm intersect with each other, so as to let the second supporting arm of the first positioning member and the fourth supporting arm of the second positioning member to be rotatable relative to the node.

16. The loading box of claim 10, wherein the first supporting arm has a plurality of brackets having different lengths and protruding from the first baffle and independently rotatable relative to the first baffle, and a number of the brackets is the same as a number of the first grooves in the first groove set, wherein the lengths of the different brackets of the first supporting arm respectively correspond to a spacing between one of the first grooves and the first side wall portion, and one of the brackets of the first supporting arm is rotated out from the first baffle to be detachably connected to the first side wall portion.

17. The loading box of claim 16, wherein one or more of the brackets are respectively formed into a hollow frame shape, such that a shorter one of the brackets is capable to be placed in a hollow area of the frame shape of a longer one of the brackets when being received in the first baffle.

18. A loading box, comprising:

a box body, having a base and a side wall protruding from the base along a plurality of sides of the base, wherein the sides comprise a first side and a second side intersecting with each other, and the side wall comprises a first side wall portion located on the first side and a second side wall portion located on the second side; and a first positioning member, comprising:

a first baffle, disposed along the first side; and a first supporting arm and a second supporting arm, respectively connected to the first baffle and protruding from the first baffle toward the side wall, wherein one ends of the first supporting arm and the second supporting arm of the first positioning member away from the first baffle are respectively detachably connected to the box body corresponding to the first side wall portion and the second side wall portion, the second supporting arm of the first positioning member is an arcuate supporting arm having a radian, and a center of curvature of the second supporting arm having a radian is located on a side of the second supporting arm opposite to the side wall.

19. The loading box of claim 18, further comprising a buffer plate, wherein the buffer plate is made of a material having a rigidity less than that of the first baffle, and is attached to a side of the first baffle facing a center of the base.

20. The loading box of claim 18, wherein the first baffle is at least partially hollowed-out.

21. The loading box of claim 18, further comprising:

a second positioning member, comprising:

a second baffle, disposed along the second side; and a third supporting arm and a fourth supporting arm, respectively connected to the second baffle and protruding from the second baffle toward the side wall, wherein one ends of the third supporting arm and the fourth supporting arm of the second positioning member away from the second baffle are respectively detachably connected to the box body corresponding to the second side wall portion and the first side wall portion, the fourth supporting arm of the second positioning member is an arcuate supporting arm having a radian, a center of curvature of the fourth supporting arm having a radian is located on a side of the fourth supporting arm opposite to the side wall, and the second supporting arm of the first positioning member intersects with the fourth supporting arm of the second positioning member.

* * * * *